US011540649B2

(12) United States Patent
Bhat et al.

(10) Patent No.: US 11,540,649 B2
(45) Date of Patent: Jan. 3, 2023

(54) CARRY HANDLE ANCHOR SYSTEM

(71) Applicant: Dorel Juvenile Group, Inc., Foxboro, MA (US)

(72) Inventors: Vishwanath Bhat, Foxboro, MA (US); Nathan W. Heisey, Seymour, IN (US); Devin J. Coakley, Bellingham, MA (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 37 days.

(21) Appl. No.: 17/230,207

(22) Filed: Apr. 14, 2021

(65) Prior Publication Data

US 2021/0315394 A1 Oct. 14, 2021

Related U.S. Application Data

(60) Provisional application No. 63/009,594, filed on Apr. 14, 2020.

(51) Int. Cl.
*A47D 15/00* (2006.01)
*A47D 13/02* (2006.01)

(52) U.S. Cl.
CPC ..... *A47D 15/00* (2013.01); *A47D 13/025* (2013.01)

(58) Field of Classification Search
CPC .. G10G 5/005; A44B 17/007; A44B 17/0023; A47D 13/025; A47D 1/10; A47D 15/00
See application file for complete search history.

(56) References Cited

U.S. PATENT DOCUMENTS

| | | | | |
|---|---|---|---|---|
| 5,054,170 | A | 10/1991 | Otrusina | |
| 5,906,031 | A | 5/1999 | Jensen | |
| 6,059,156 | A | 5/2000 | Lehtinen | |
| 6,170,910 | B1 | 1/2001 | Bapst | |
| 6,341,918 | B1 | 1/2002 | Staffan | |
| 6,367,875 | B1 | 4/2002 | Bapst | |
| 6,626,336 | B1 | 9/2003 | Krusell | |
| 6,955,280 | B2 | 10/2005 | Saitoh | |
| 6,981,623 | B2 | 1/2006 | Iitsuka | |
| 7,765,652 | B2 | 8/2010 | Nakamuru | |
| 7,818,851 | B2 * | 10/2010 | Perrotta | G10G 5/005 24/701 |
| 8,464,403 | B2 | 6/2013 | Fiedler | |
| 8,464,919 | B1 | 6/2013 | Goozdich | |
| 8,914,951 | B2 | 12/2014 | Gaudillere | |
| 8,919,623 | B1 | 12/2014 | Bergeron | |
| 9,049,894 | B2 | 6/2015 | Wong | |
| 9,907,368 | B2 | 3/2018 | Paik | |
| 9,924,780 | B2 | 3/2018 | Park | |
| 10,080,421 | B2 | 9/2018 | Binding | |
| 10,971,120 | B2 * | 4/2021 | Kajihara | G10G 5/005 |
| 2005/0284282 | A1 * | 12/2005 | D'Addario | G10G 5/005 84/327 |
| 2008/0098871 | A1 * | 5/2008 | McAnelly | G10G 5/005 84/327 |

(Continued)

*Primary Examiner* — Derek J Battisti
(74) *Attorney, Agent, or Firm* — Barnes & Thornburg LLP

(57) ABSTRACT

A carry handle includes a shoulder strap and strap anchors at opposite ends of the shoulder strap. Each strap anchor can be mated to one end of an object to be carried to allow a user to wear the carry handle in an over-the-shoulder manner. The carry handle can be coupled to an infant carrier for use by a caregiver during transport of the infant carrier.

22 Claims, 16 Drawing Sheets

(56) References Cited

U.S. PATENT DOCUMENTS

| | | | | |
|---|---|---|---|---|
| 2009/0304306 | A1 | 12/2009 | Will | |
| 2011/0309121 | A1 | 12/2011 | Dooley | |
| 2015/0135486 | A1 | 5/2015 | Fiedler | |
| 2016/0003269 | A1 | 1/2016 | Russell-Clarke | |
| 2017/0206871 | A1* | 7/2017 | Steinberger ..... | A44B 17/007 |
| 2017/0273446 | A1 | 9/2017 | Zentil | |
| 2018/0055245 | A1 | 3/2018 | Foged | |

* cited by examiner

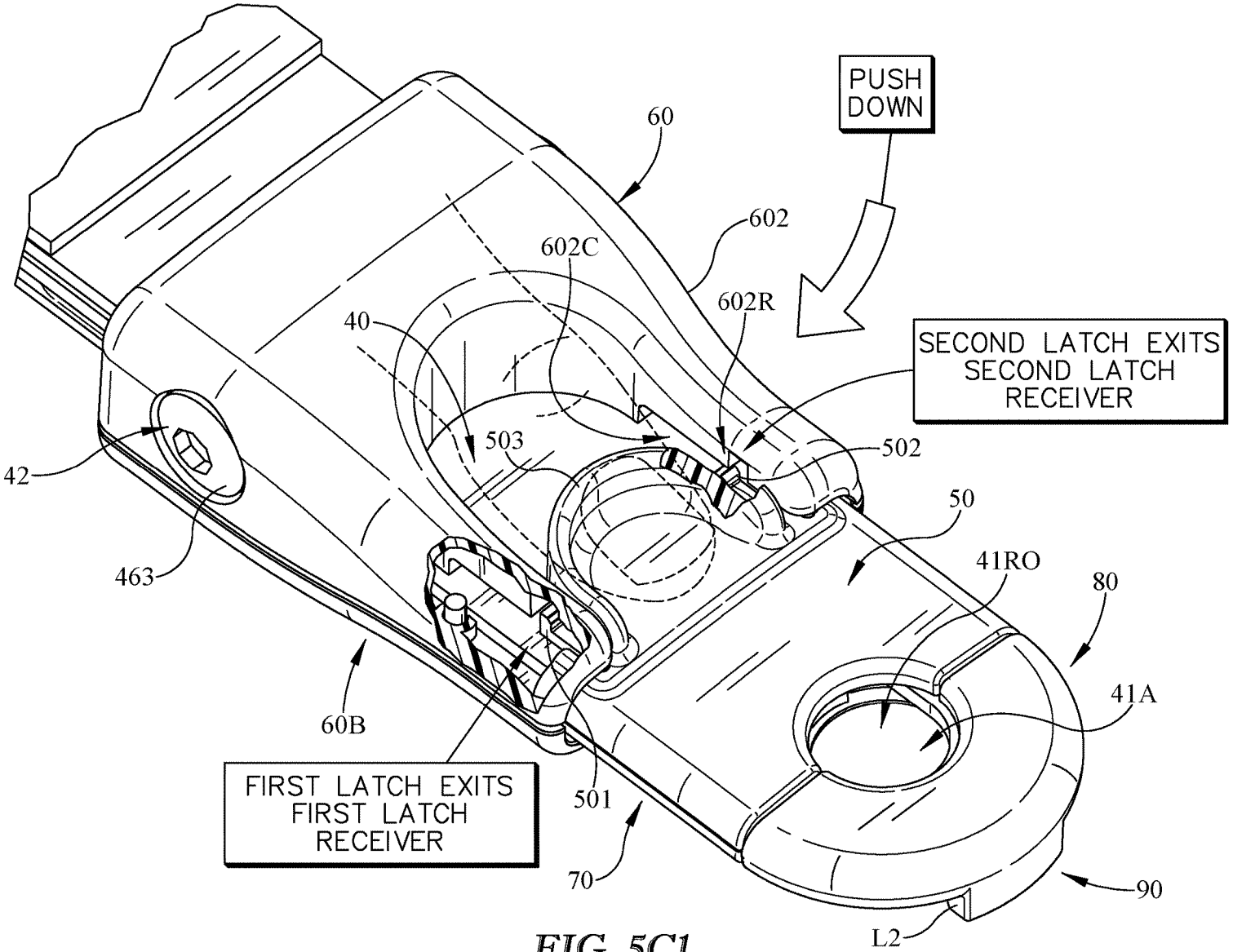
FIG. 5C1

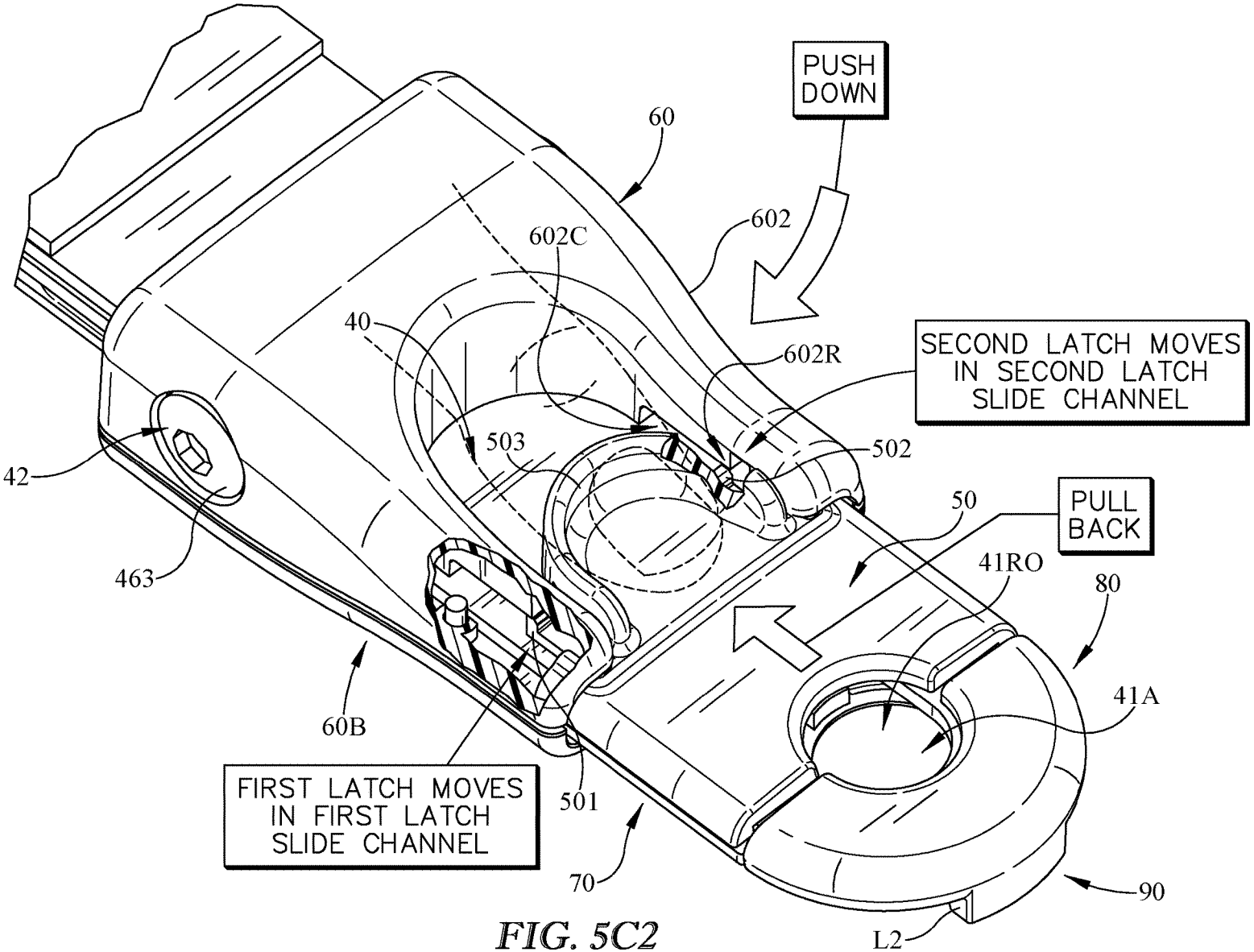
FIG. 5C2

CARRY HANDLE ANCHOR SYSTEM

PRIORITY CLAIM

This application claims priority under 35 U.S.C. § 119(e) to U.S. Provisional Application No. 63/009,594 filed Apr. 14, 2020, which is expressly incorporated by reference herein.

BACKGROUND

The present disclosure relates to a carry handle for carrying an object, and particularly to an anchor for coupling one end of the carry handle to a handle mount on the object. More particularly, the present disclosure relates to a child restraint carry handle anchor.

SUMMARY

A carry handle anchor system in accordance with the present disclosure is used to connect one end of a carry handle to an object to be carried by a person. In illustrative embodiments, the carry handle anchor system comprises a (1) carry handle including an anchor and (2) an anchor post cantilevered to the object to be carried. The anchor that is included in the carry handle is configured to mate with the anchor post that is coupled to the object to be carried using a PUSHDOWN-PULLBACK-MOUNT-RELEASE-AND-TURN sequence in accordance with the present disclosure.

In illustrative embodiments, the carry handle anchor system is included in a child restraint used by a caregiver to mate a carry handle to an infant excursion seat. The carry handle anchor system includes a first anchor post adapted to be coupled to one end of an object (e.g. an infant excursion seat) to be carried and a second anchor post adapted to be coupled to an opposite end of that object.

The carry handle anchor system also includes a carry handle includes a carry strip, a first anchor coupled to one end of the carry strip, and a second anchor coupled to an opposite end of the carry strip. The first anchor can be mated to the first anchor post and the second anchor can be mated to the second anchor post in accordance with the present disclosure to couple the carry handle to the object to be carried.

In illustrative embodiments, in the case of an infant carrier, the anchor at each end of the carry strip could be mated by a caregiver in accordance with the present disclosure to a companion anchor post coupled to one of the head and foot ends of infant carrier. Then the carry strip could be worn on the caregiver's shoulder to hold the infant carrier in a comfortable position along the waist of the caregiver.

In illustrative embodiments, the first anchor post includes an oblong head and a head-support shaft coupled to an underside of the oblong head to support the oblong head in spaced-apart relation to an object to be carried such as an infant excursion seat. The first anchor post further includes a rotation-blocker platform adapted to be mounted on one end of the infant excursion seat and used to limit rotation of the first anchor about a central post axis established by the head-support shaft of the first anchor post to establish a FIRST SIDE-STORAGE position of the first anchor in which the carry strip that is coupled to the first anchor is self-supported to lie along a first side of the infant excursion seat and also to establish a SECOND SIDE-STORAGE position in which the carry strip that is coupled to the first anchor is self-supported to lie along an opposite second side of the infant excursion seat. The head-support shaft has a proximal end cantilevered to the rotation-blocker platform and an opposite distal end cantilevered to the underside of the oblong head.

In illustrative embodiments, the first anchor of the carry handle includes a foundation formed to include an oblong anchor post-receiving aperture and a spring-biased aperture shape changer mounted on the foundation for sliding movement to change the effective size and shape of the oblong anchor post-receiving aperture. In a temporarily RETRACTED position of the spring-biased aperture shape changer on the foundation, the oblong anchor post-receiving aperture is fully exposed to allow a user to align the oblong head with the oblong anchor post-receiving aperture and then pass the oblong head of the first anchor post through the oblong anchor post-receiving aperture in a first direction to locate the head-support shaft included in the first anchor post and coupled to the oblong head in the oblong anchor post-receiving aperture.

In illustrative embodiments, the spring-biased aperture shape changer is supported on the foundation for movement between a normally EXTENDED position in which the effective size and shape of the oblong anchor post-receiving anchor is reduced to block passage of the oblong head through that aperture and a temporarily RETRACTED position in which the oblong anchor post-receiving aperture is fully exposed to allow movement of the oblong head of the first anchor post through the oblong anchor post-receiving aperture formed in the foundation of the first anchor. In use, the spring-biased aperture shape changer is first PUSHED DOWN toward the foundation by a finger of a user to free the spring-biased aperture shape changer for back-and-forth sliding movement on the foundation and then PULLED BACK by the user to move from the EXTENDED positon to the RETRACTED position. This retraction OPENS the oblong anchor post-receiving aperture to allow a user to MOUNT the first anchor on the first anchor post that is coupled to the object to be carried by passing the oblong head through the oblong anchor post-receiving aperture to locate the head-support shaft in the oblong anchor post-receiving aperture. Then the user RELEASES the spring-biased aperture shape changer to allow the aperture shape changer to move automatically from the temporarily RETRACTED position to the normally EXTENDED position so as to reduce the effective size and shape of the oblong anchor post-receiving aperture to a ROUND shape that is just larger than the head-support shaft so that the first anchor is free to be rotated by the user about the central post axis established by the head-support shaft and yet the first anchor will remain mated to the first anchor post because the effective shape and size of the oblong anchor post-receiving aperture has been reduced to block movement of the oblong head through the relatively smaller anchor post-receiving aperture so as to prevent unmating of the first anchor of the carry handle from the first anchor post on the object to be carried.

In illustrative embodiments, the oblong head of the first anchor post is oriented to extend generally in a horizontal direction to cause the first anchor to be oriented to assume either the FIRST or SECOND SIDE-STORAGE position when the first anchor is mated to the first anchor post using a PUSHDOWN-PULLBACK-MOUNT-AND-RELEASE sequence in accordance with the present disclosure. A final illustrative step in the sequence is for the user to TURN the first anchor about the central post axis established by the head-support shaft from one of the FIRST and SECOND SIDE-STORAGE position while the aperture shape changer remains in the EXTENDED position to move the carry strip from a self-supported position along one of the sides of the infant excursion seat to lie above an infant-carrying space formed in the infant excursion seat so that the carry handle may be worn in an over-the-shoulder manner by a caregiver.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed disclosure particularly refers to the accompanying figures in which:

FIG. 5 is a perspective view showing that one end of the semi-rigid strap support is mated with a rearwardly extending plate included in the strip holder and cantilevered to the tongue plate, the strip-mount rod components are mounted to the rod support, and the bottom shell of the top-cover slide guide is mounted under the foundation and showing that the slidable bottom cover is arranged to slidably engage the bottom shell and an aperture shape changer-biasing spring having a forward end engaging a spring-engagement pad included in the slidable bottom cover and a rearward end engaging a spring wall included in tongue plate;

FIG. 5C is a perspective view similar to FIG. 5B after the slidable top cover is mounted on the tongue plate with portions broken away to reveal a portion of the first motion-blocking latch that is included in the slidable top cover on the left side of the curved finger grip and a portion of the second motion-blocking latch that is included in the slidable top cover on the right side of the curved finger grip;

FIG. 5C1 is a perspective view similar to FIG. 5C illustrating a first PUSHDOWN step in accordance with the present disclosure in which the user first pushes down on the spring-biased aperture shape changer to release the aperture shape changer from a temporarily locked non-sliding position to free the aperture shape changer so that it can be slid by the user away from the EXTENDED position toward the RETRACTED position;

FIG. 5C2 is a perspective view similar to FIGS. 5C and 5C1 illustrating a subsequent PUSHDOWN step in accordance with the present disclosure in which the user pulls back on the spring-biased aperture shape changer while continuing to push down to cause the aperture shape changer to begin to slide rearwardly on the foundation from the EXTENDED position in a direction toward the RETRACTED position to compress the spring that biases the aperture shape changer toward the EXTENDED position and also to begin to change the effective size and shape of the anchor-post receiving aperture formed in the foundation from the ROUND shape shown in FIGS. 5C and 6 to the fully exposed OBLONG shape shown in FIG. 7;

FIG. 6 is a perspective view showing that the first anchor post on the foot end of the infant excursion seat includes an oblong head coupled to a distal end of a cantilevered head-support shaft that is rooted on a raised rotation-blocker platform that is arranged to lie alongside a U-shaped anti-rotation-lug guide as shown in more detail in FIGS. 12 and 13 and also showing the foot-end first anchor before it is mated with the first anchor post to couple one end of the carry handle to the foot end of the infant excursion seat and showing that the aperture shape changer is in its normal EXTENDED position to reduce the effective shape and size of the oblong anchor post-receiving aperture to a ROUND POST receiver;

FIG. 7 is a view similar to FIG. 6 showing a first PULLBACK step in a post-mating process in accordance with the present disclosure in which a round post receiver formed in the foot-end first anchor as shown in FIG. 6 is expanded temporarily to generate an oblong post receiver sized to receive the oblong head of the first anchor post as shown in FIG. 8 in response to sliding retracting movement of a spring-biased slidable aperture cover in a rearward direction toward the strip holder and away from a companion C-shaped end piece to a temporary RETRACTED position to change the shape of the post receiver provided in the foot-end first anchor;

FIG. 8 is a view similar to FIG. 7 showing that the user has moved the foot-end first anchor toward the first anchor post to cause the oblong head of the first anchor post to fit in the temporarily expanded oblong post receiver formed in the foot-end first anchor;

FIG. 9 is a view similar to FIG. 8 showing movement of the foot-end first anchor toward the foot end of the infant excursion seat to cause the oblong head of the first anchor post to pass through the temporarily expanded oblong post receiver formed in the foot-end first anchor during a subsequent MOUNT step in the post-mating process in accordance with the present disclosure that takes place in an initial stage of mating engagement of the mobile foot-end first anchor of the carry handle with the stationary first anchor post that is coupled to the foot end of the infant excursion seat so that the cylindrical head-support shaft of the first anchor post now lies in the round post receiver provided in the foot-end first anchor and showing a subsequent RELEASE step in which the user has released the spring-biased aperture shape changer to allow it to move automatically from the temporary RETRACTED position to the normal EXTENDED position;

FIG. 10 is a view similar to FIG. 9 showing the TURN step in the post-mating process in accordance with the present disclosure that takes place in subsequent stages of mating engagement of the foot-end first anchor of the carry handle with the first anchor post on the infant excursion seat as the user turns the foot-end first anchor about a central post axis established by the first anchor post;

FIG. 11 is a view similar to FIG. 10 showing rotation of the foot-end first anchor about an axis of rotation established by the head-support shaft of the first anchor post through an angle of about 90° during completion of a TURN step in the post-mating process in accordance with the present disclosure;

DETAILED DESCRIPTION

Figure 1:
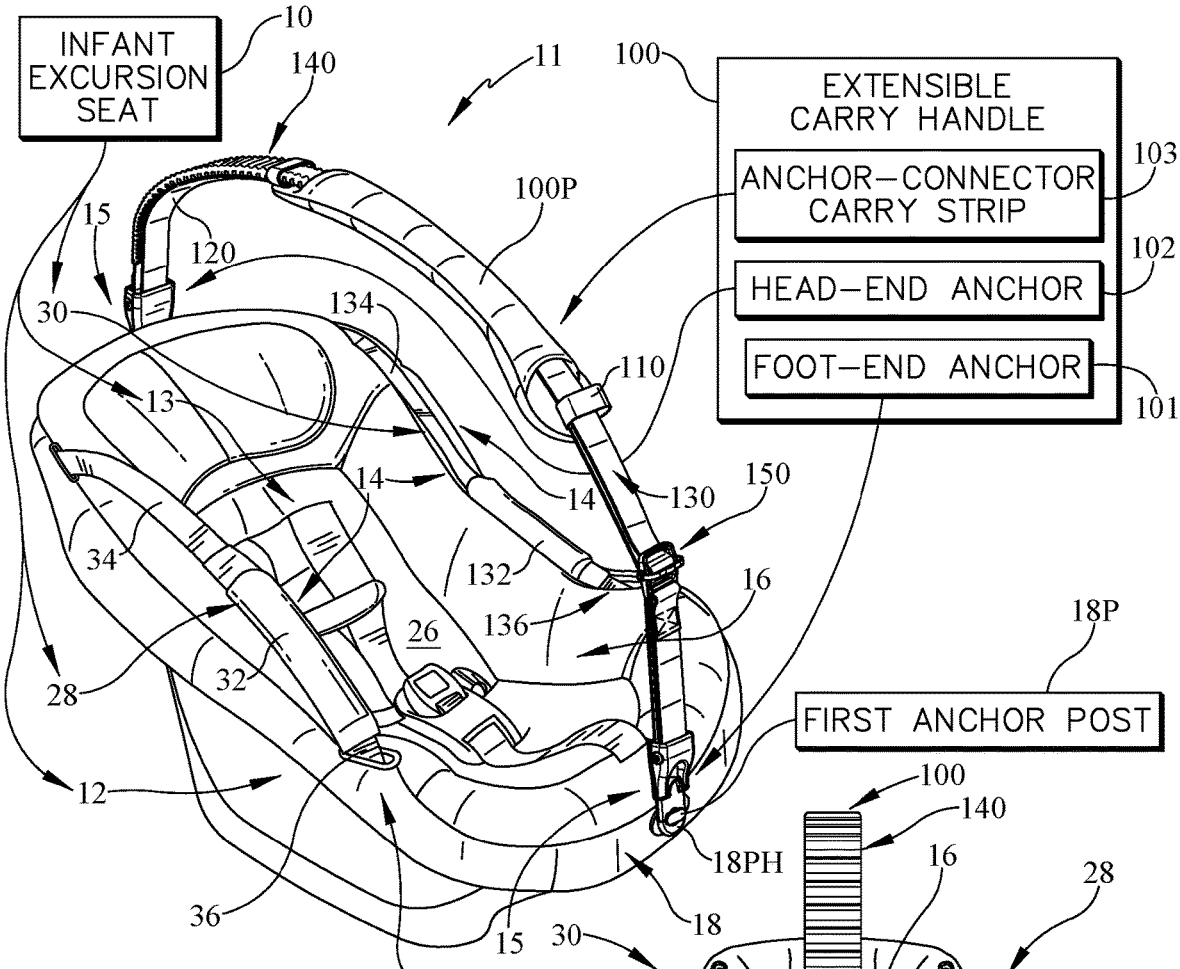
FIG. 1 is a perspective view of a child restraint including a carry handle in accordance with the present disclosure and showing that the child restraint includes an infant excursion seat configured to hold a seated child, an end-mounted carry handle extending from a head end of the seat to a foot end of the seat and including a shoulder pad adapted to facilitate shoulder carrying of the infant excursion seat and showing that a first end of the carry handle is coupled to the foot end of the infant excursion seat by mating a foot-end first anchor that is included in the carry handle to a first anchor post that is mounted on the foot end of the infant excursion seat.

A child restraint 11 using a carry handle anchor system 15 in accordance with the present disclosure comprises an infant excursion seat 10 and a self-supported end-mounted extensible carry handle 100 coupled to opposite ends 18, 20 of infant excursion seat 10 as shown in FIG. 1. A seating bucket 12 included in infant excursion seat 10 can be carried by a caregiver using self-supported end-mounted extensible carry handle 100 or by using two side-mounted carry handles 28, 30.

Figure 2:
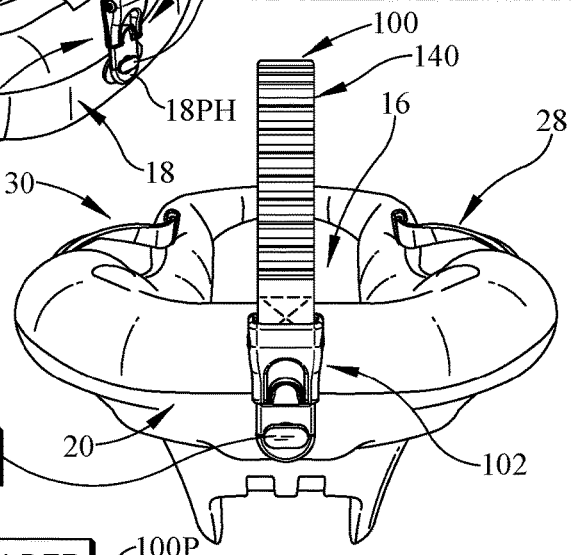
FIG. 2 is an end elevation view of the child restraint of FIG. 1 showing that a second end of the carry handle is coupled to the head end of the infant excursion seat by mating a head-end second anchor that is included in the carry handle to a second anchor post that is mounted on the head end of the infant excursion seat.
Figure 3:
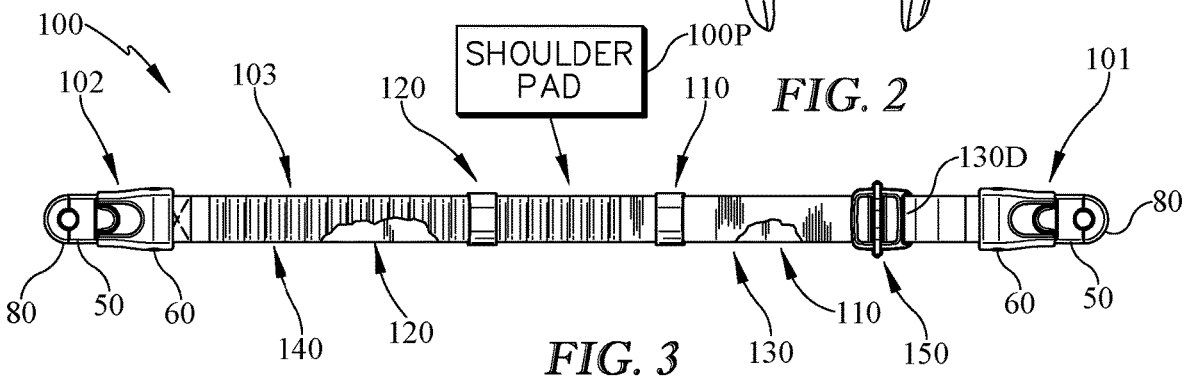
FIG. 3 is a reduced-size top plan view of the carry handle of FIGS. 1 and 2 showing that an anchor-connector carry strip is included in the carry handle and arranged to interconnect the head-end and foot-end anchors also included in the carry handle.
Figure 12:
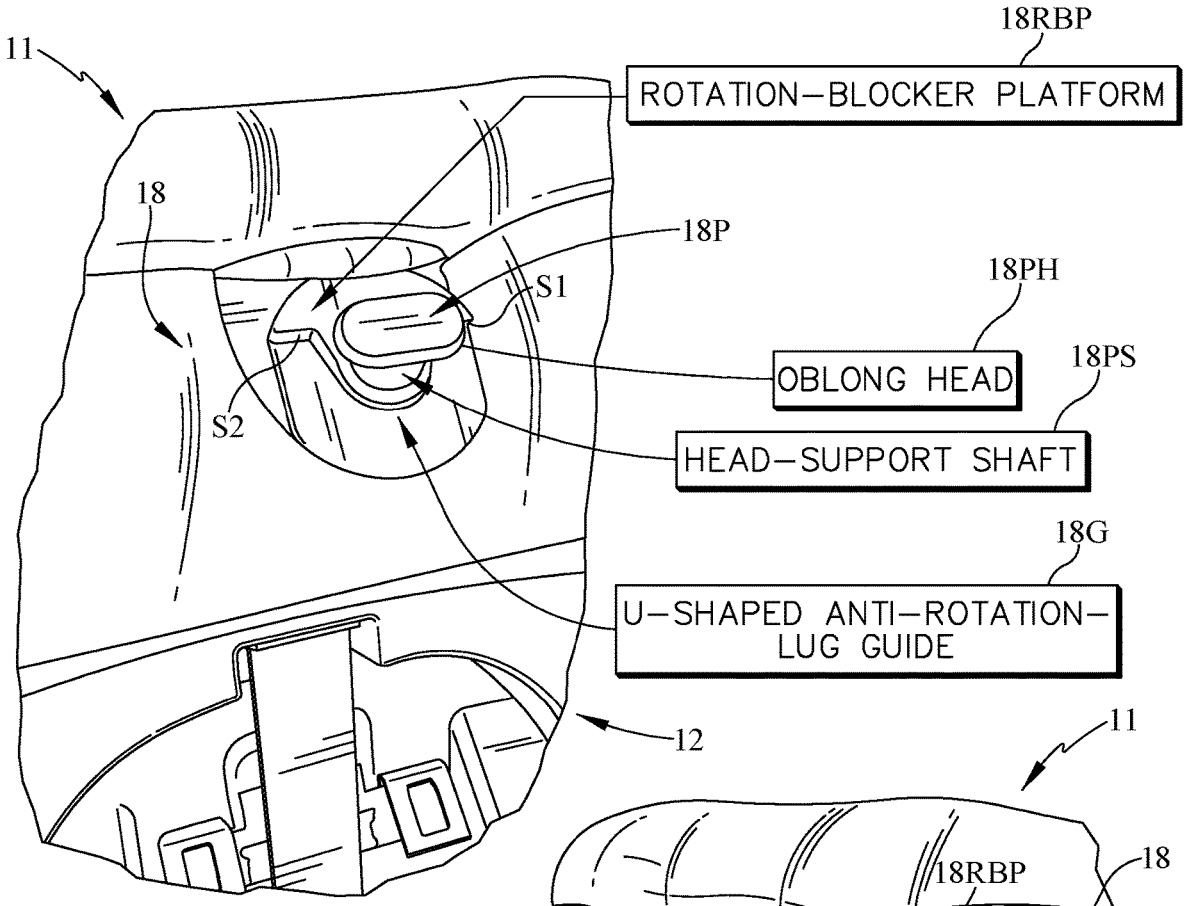
FIG. 12 is a perspective view of the first anchor post taken from a first point of view to show that the first anchor post includes an oblong head coupled to a free end of a cantilevered cylindrical head-support shaft that is coupled to a raised rotation-blocker platform that is coupled to a foot end of the infant excursion seat.
Figure 13:
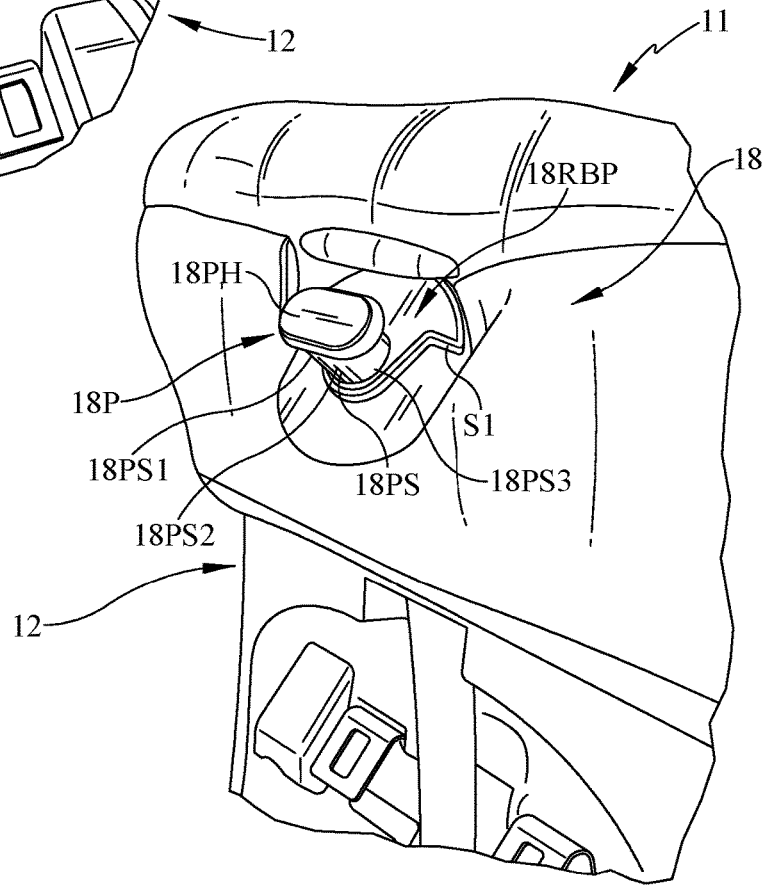
FIG. 13 is a perspective view of the first anchor post taken from a second point of view.

The end-mounted extensible carry handle 100 of child restraint 11 includes a foot-end anchor 101, an opposite head-end anchor 102, and an anchor-connector carry strip 103 that is arranged to interconnect the foot-end and head-end anchors 101, 102 as shown in FIGS. 1 and 3. When the extensible carry handle 100 is installed on seating bucket 12 of infant excursion seat 10 as shown in FIG. 1, foot-end anchor 101 is mated with a first anchor post 18P cantilevered to a foot end 18 of seating bucket 12 as shown in FIG. 1 and second-end anchor 102 is mated with a second anchor post 20P cantilevered to a head end 20 of seating bucket 12 as shown in FIG. 2. First anchor post 18P is illustrated in FIGS. 12 and 13 and second anchor post 20P has a similar configuration. Carry handle anchor system 13 comprises first anchor post 18P, second anchor post 20P, and carry handle 100 including carry strip 103 and first and second anchors 101, 102.

Foot-end anchor 101 is mated with first anchor post 18P on foot end 18 of seating bucket 12 using a PUSHDOWN-PULLBACK-MOUNT-RELEASE-AND-TURN sequence in accordance with the present disclosure as shown, for example, in FIGS. 6-11 to couple one end of extensible carry handle 100 to infant excursion seat 10. Similarly, head-end anchor 102 is mated with second anchor post 20P on head end 20 of seating bucket 12 using a similar PUSHDOWN-PULLBACK-MOUNT-RELEASE-AND-TURN sequence in accordance with the present disclosure to couple another end of extensible carry handle 100 to infant excursion seat 10.

Infant excursion seat 10 includes a seating bucket 12 for holding an infant and first and second side carry handles 28, 30 that are coupled to seating bucket 12 and are gripped by a caregiver to transport infant excursion seat 10 after separation from a companion stroller frame or excursion-seat carrier or from a vehicle passenger seat (none of which are shown). Infant excursion seat 10 includes a hand grip 32 or 132 in each of the first and second side carry handles 28, 30 and an extensible grip tether 36 or 136 that yieldably and automatically moves its companion hand grip 32 or 132 of each carry handle 28, 30 normally to a LOWERED STORAGE position alongside the seating bucket 12 and frees the companion hand grips 32 or 132 to be moved by a caregiver upwardly away from the seating bucket 12 from the LOWERED STORAGE position to a RAISED BUCKET-CARRYING position so that the caregiver can grip both hand grips 32, 132 in one hand and carry the infant in the seating bucket 12.

Child restraint 11 comprises an infant excursion seat 10 including a seating bucket 12, a child-restraint harness 13, and a side-mounted bucket carrier 14 as shown in FIGS. 1 and 2. Seating bucket 12 is formed to include an interior child-carrying space 16 as suggested in FIGS. 1 and 2. Seating bucket 12 includes a foot end 18, an opposite head end 20, a first side wall 22 extending between the foot and head ends 18, 20, and a second side wall 24 extending between the foot and head ends 18, 20 and lying in spaced-apart relation to the first side wall 22 to locate the interior child-carrying space 16 therebetween as shown in FIG. 1. Seating bucket 12 also includes a floor 26 coupled to each of walls 22, 24 and ends 18, 20. Side-mounted bucket carrier 14 includes a first side carry handle 28 associated with first side wall 22 of seating bucket 12 and a second side carry handle 30 associated with second side wall 24 of seating bucket 12. Infant excursion seat 10 can be carried using the side-mounted first and second carry handles 28, 30 after they have been pulled upwardly by a caregiver from a LOWERED STORAGE position shown in FIGS. 1 and 2 to a relatively higher RAISED BUCKET-CARRYING position.

First side carry handle 28 includes a first-hand grip 32, a head-end grip tether 34, and a foot-end grip tether 36 as shown in FIG. 1. First hand grip 32 is arranged to be gripped and moved relative to seating bucket 12 by a person carrying seating bucket 12 from a LOWERED STORAGE position shown in FIG. 1 located in close proximity to foot end 18 of seating bucket 12 to a relatively higher RAISED BUCKET-CARRYING position that is and located above a mid-section of first side wall 22 and between the foot and head ends 18, 20 of seating bucket 12. Head-end grip tether 34 is arranged to interconnect first hand grip 32 and head end 20 of seating bucket 12. Foot-end grip tether 36 is arranged to interconnect first hand grip 32 and foot end 18 of seating bucket 12. Second side carry handle 30 is similar to first side carry handle 28 and includes a second hand grip 132, a head-end tether 34, and a foot-end grip tether 136 as also shown in FIG. 1.

Child restraint 11 includes an infant excursion seat 10 configured to hold a seated child (not shown), and a self-supported end-mounted extensible carry handle 100 extending from a head end 20 of seat 10 to a foot end 18 of seat 10 as shown in FIGS. 1 and 2A. Shoulder pad 100P is included in end-mounted extensible carry handle 100 and is adapted to facilitate shoulder carrying of seating bucket 12 as an alternative to the use of the first and second side carry handles 28, 30 included in side-mounted bucket carrier 14.

End-mounted extensible carry handle 100 can be stretched from a normal UNSTRETCHED mode shown in FIGS. 1 and 2 to a temporary STRETCHED mode (not shown) when seating bucket 12 is lifted upwardly away from an underlying surface and supported in a LIFTED position using shoulder pad 100P. A caregiver can use end-mounted extensible carry handle 100 in a worn-over-the-shoulder manner to carry seating bucket 12 at waist level to transport an infant (not shown) located in an infant-receiving space 16 formed in seating bucket 12.

A top plan view of the extensible carry handle 100 before it is mounted on foot and head ends 18, 20 of seating bucket 12 is provided in FIG. 3. Extensible carry handle 100 includes a foot-end anchor 101 adapted to be mated with a first anchor post 18P coupled to foot end 18 of seating bucket 12 as shown in FIG. 1, a semi-rigid strap support 110 cantilevered to foot-end anchor 101, a head-end anchor 102 adapted to be mated with a second anchor post 20P coupled to head end 20 of seating bucket 12 as shown in FIG. 2, a semi-rigid bungee support 120 cantilevered to head-end anchor 102 and arranged to extend toward the semi-rigid strap support 110, a shoulder pad 100P (shown diagrammatically) interposed between the semi-rigid strap and bungee supports 110, 120 (as shown illustratively in FIG. 1), and an anchor-connector carry strip 103 arranged to interconnect foot-end and head-end anchors 101, 102 and extend along each of the underlying semi-rigid strap and bungee supports 110, 120 and mate with shoulder pad 100P for sliding movement relative to shoulder pad 100P. Anchor-connector carry strip 103 includes an adjustable-length strap section 130 coupled to foot-end anchor 101 and supported by semi-rigid strap support 110 and an elastic bungee section 140 supported by semi-rigid bungee support 120 and arranged to interconnect head-end anchor 102 and the adjustable-length strap section 130. A length adjuster 150 is provided to be coupled to a distal end 130D and mid-section 130M of the adjustable-length strap section 130 as suggested in FIG. 14 and configured to be used by a handle user to change the effective length of the adjustable-length strap section 130 to change length of the extensible carry handle 100. Flexible anchor-connector carry strip 103 is supported by the underlying semi-rigid strap support 110 and bungee support 120 to provide the self-support features of carry handle 100 in accordance with the present disclosure.

Figure 14:
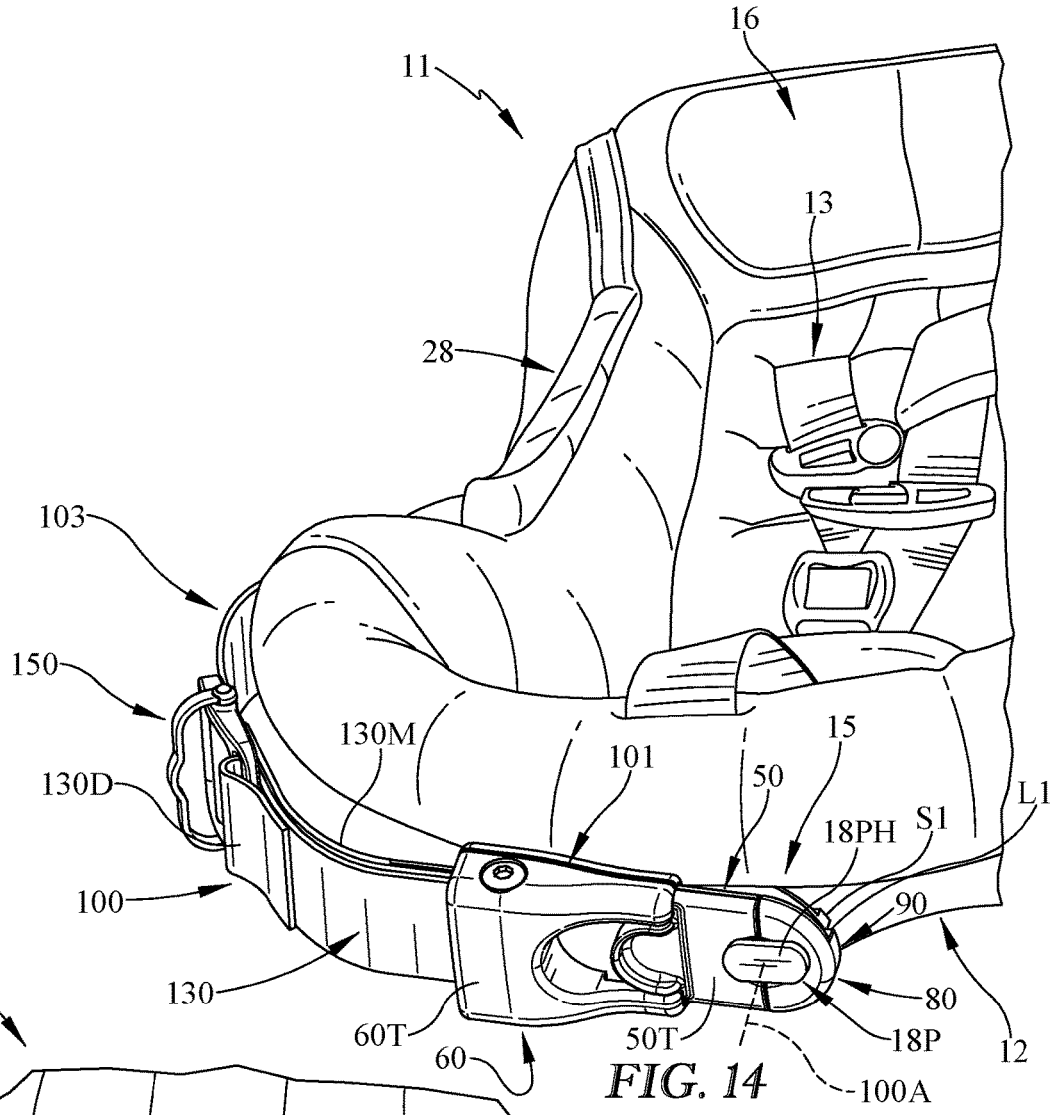
FIG. 14 is a perspective view of a portion of the infant excursion seat of FIGS. 1 and 2 showing counter-clockwise rotation of the foot-end first anchor and the carry handle about the axis of rotation that extends through the first anchor post from an UPRIGHT USE position shown in FIGS. 1 and 2 to a FIRST-SIDE STORAGE position alongside a first side of the infant excursion seat.

Extensible carry handle 100 is shown in its UNSTRETCHED mode in FIG. 3 before it is attached to the anchor posts 101, 102 that are located at opposite ends 18, 20 of seating bucket 12 as suggested in FIG. 1. Infant excursion seat 10 is shown in FIG. 14 after the self-supported end-mounted extensible carry handle 100 has been mounted on the first and second anchor posts 101, 102 and arranged to overlie the child-carrying space 16. Carry handle 100 is self-supported and mounted for rotation about a longitudinally extending axis of rotation 100A and rotated 90° from an UPRIGHT USE position shown in FIG. 1 to one of two available ROTATED STORAGE positions shown in FIG. 14.

Extensible carry handle 100 is attachable to an infant seat 10 to help users carry their child. Extensible carry handle 100 comprises a long strip 103 configured to go across a caregiver's shoulder to allow for hands free carrying of infant seat 10 in a comfortable ergonomic position. This transfers the weight of the infant seat 10 and the child in seat 10 into the stronger portions of the caregiver's body allowing the caregiver to carry infant seat 10 comfortably over long periods of time without blocking the ability of the caregiver to rotate the extensible carry handle 100 about axis of rotation 100A to free seat to be carried in an alternative manner using the carry handles 28, 30 included in bucket carrier 14.

Child restraint 11 includes an infant excursion seat 10 configured to hold a seated child, an end-mounted carry handle 100 extending from a head end 20 of seat 10 to a foot end 18 of seat 10. Carry handle 100 includes a shoulder pad 100 adapted to facilitate shoulder carrying of infant excursion seat 10. A first end of carry handle 100 is coupled to foot end 18 of infant excursion seat 10 by mating a foot-end first anchor 101 that is included in carry handle 100 to a first anchor post 18P that is mounted on foot end 18 of infant excursion seat 10 as shown in FIG. 1 in accordance with the present disclosure using a process shown, for example, in FIGS. 6-11. An end elevation view of child restraint 11 is provided in FIG. 2 to show that a second end of carry handle 100 is coupled to head end 20 of infant excursion seat 10 by mating a head-end second anchor 102 that is included in carry handle 100 to a second anchor post 20P that is mounted on head end 20 of infant excursion seat 10.

Figure 4:
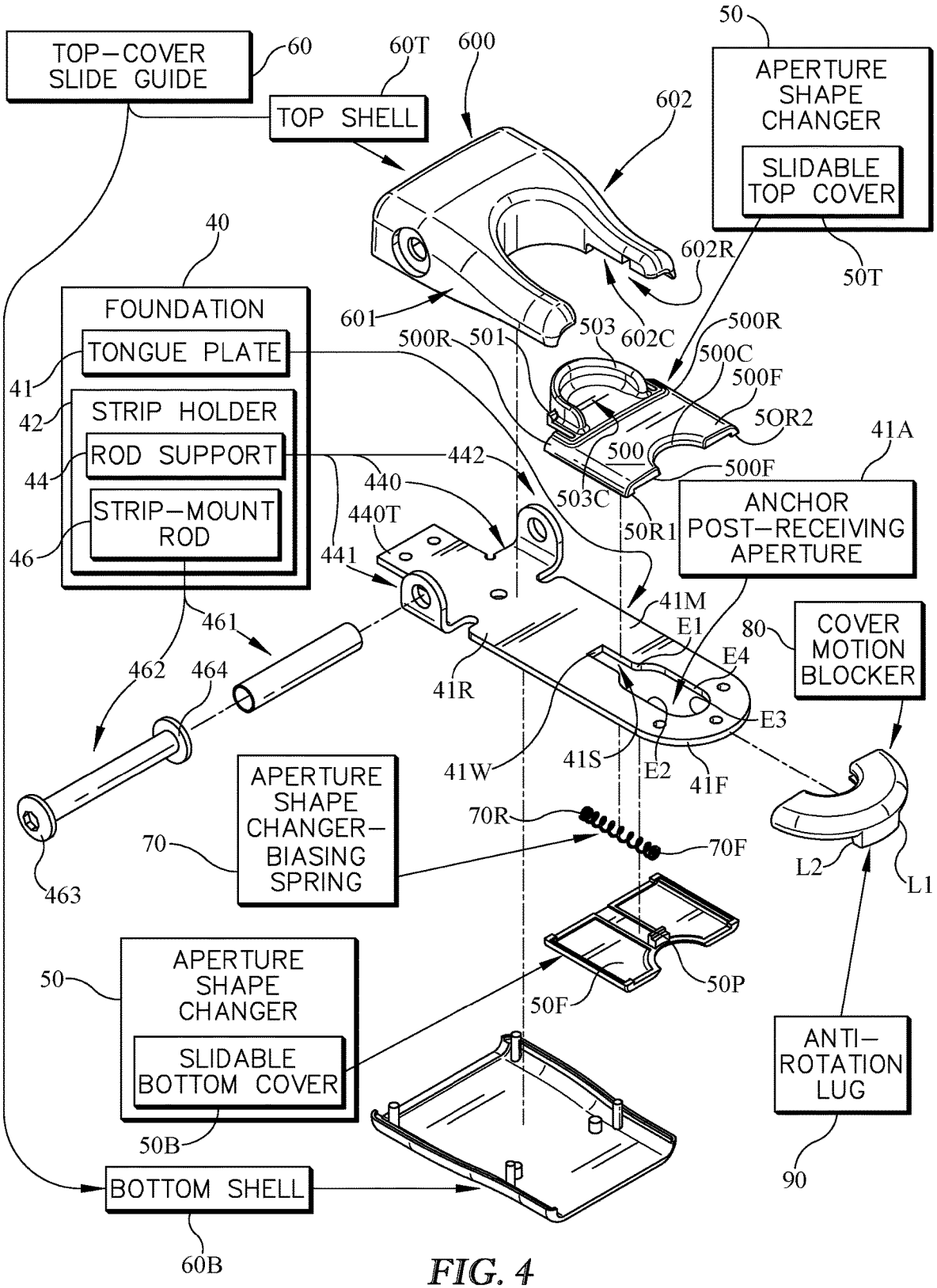
FIG. 4 is an exploded perspective assembly view of components included in each of the head-end and foot-end anchors showing that the foot-end anchor comprises a foundation including a strip holder that is configured to mate with one end of the anchor-connector carry strip and a tongue plate that is formed to include an oblong anchor post-receiving aperture that is sized to receive various portions (e.g. oblong head and head-support shaft) of the first anchor post therein during mating of foot-end anchor and first anchor post as shown, for example, in FIGS. 6-11 and showing that the foot-end anchor also includes an aperture shape changer comprising slidable top and bottom covers that slide as a unit on the tongue plate to change the shape and size of the oblong anchor post-receiving aperture, an aperture shape changer-biasing spring that operates to yieldably move the slidable top and bottom covers as a unit away from the strip holder to decrease the size of the oblong anchor post-receiving aperture to a small size with a round border shown, for example, in FIG. 5C, a cover-motion blocker mounted on a distal end of the tongue plate to engage free ends of the slidable top and bottom covers to limit movement of the slidable top and bottom covers relative to the tongue plate to establish an EXTENDED position of the aperture shape changer on the foundation, a top-cover slide guide including a top shell configured to be mounted on the foundation to cover the strip holder and formed to include motion-controller means for limiting motion of the slidable top cover on the tongue plate away from and relative to the cover motion blocker, and an anti-rotation lug coupled to the cover-motion blocker and arranged to limit rotation of the foot-end first anchor on the first anchor post about an axis of rotation from an UPRIGHT USE position shown in FIGS. 1 and 2 in a counterclockwise direction to a FIRST-SIDE STORAGE position as suggested in FIGS. 14 and 15 and in a clockwise direction to a SECOND-SIDE STORAGE position as suggested in FIGS. 16 and 17.

An exploded perspective assembly view of components included in foot-end anchor 101 is provided in FIG. 4. Foot-end anchor 101 includes a foundation 40 formed to include an oblong anchor post-receiving aperture 41A, an aperture shape changer 50 including a slidable top cover 50T and a mating slidable bottom cover 50B, a top-cover slide guide 60, an aperture shape changer-biasing spring 70, a cover-motion blocker 80, and an anti-rotation lug 90 as shown, for example, in FIG. 4.

Figure 6:
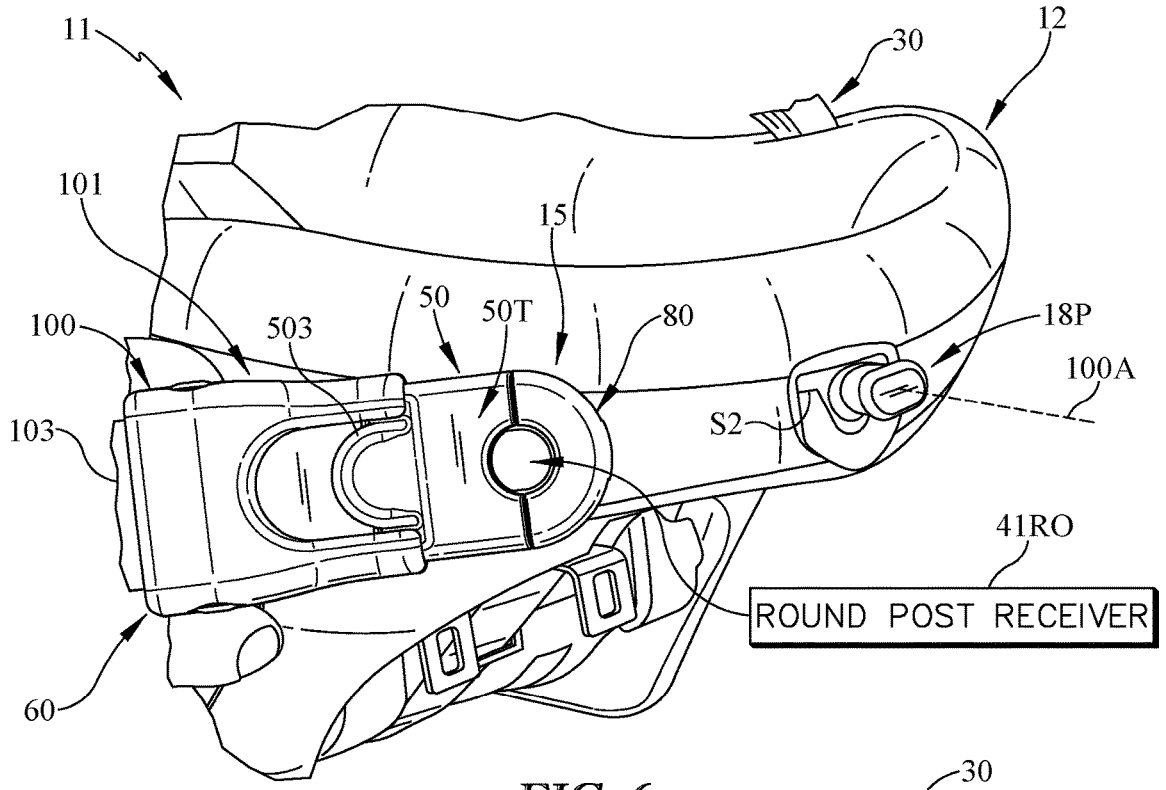
FIGS. 6-11 are a series of perspective views illustrating a PUSHDOWN-PULLBACK-MOUNT-RELEASE-AND-TURN process in accordance with the present disclosure for mating the foot-end first anchor of the carry handle to the first anchor post that is mounted on the foot end of the infant excursion seat, which process is also used in accordance with the present disclosure to mate the head-end second anchor of the carry handle to the second anchor post that is mounted on the head end of the infant excursion seat.
Figure 7:
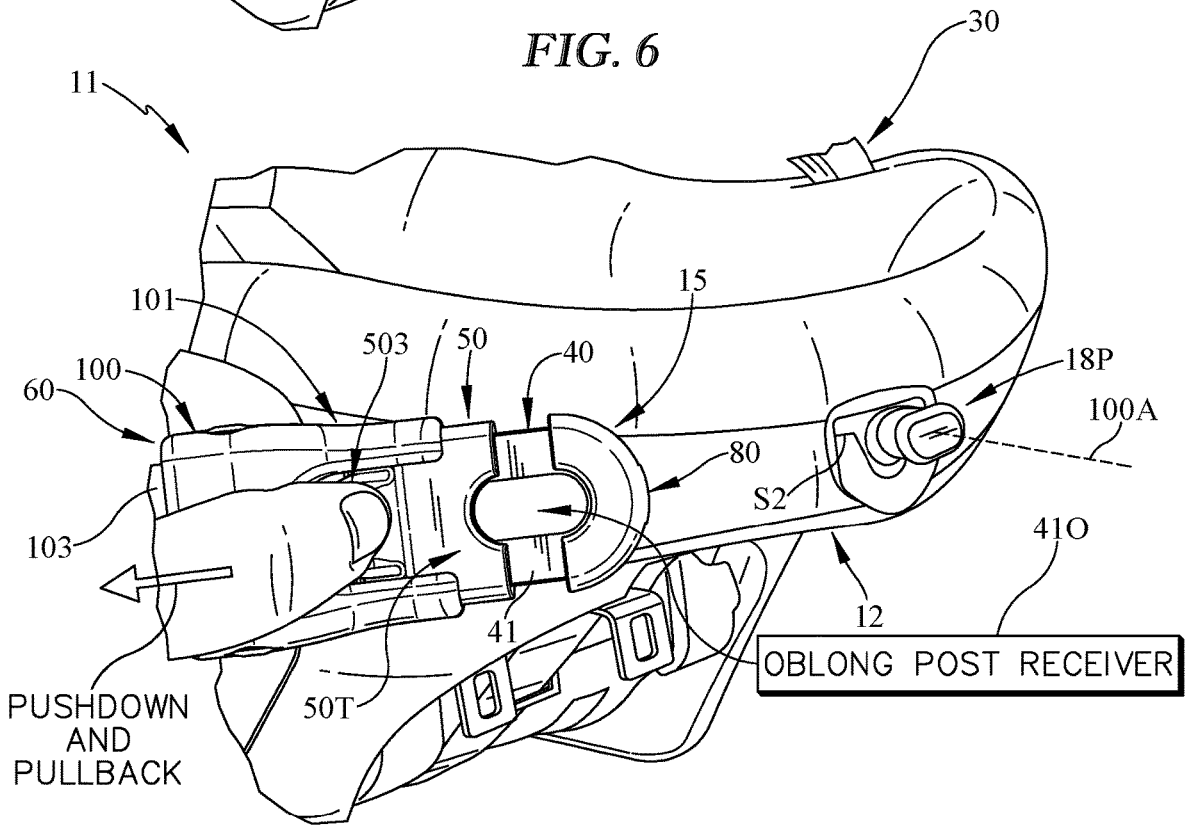

Slidable aperture shape changer 50 can slide on foundation 40 to change the effective size and shape of the anchor post-receiving aperture 41A shown in FIG. 4 from a round post receiver 41RO shown in FIG. 6 to an oblong post receiver 41O shown in FIG. 7. The aperture shape changer 50 can be slid away from cover-motion blocker 80 by a caregiver to a RETRACTED position as shown in FIG. 7 to MAXIMIZE the effective size and shape of anchor post-receiving aperture 41A to assume an oblong shape to create a temporarily expanded oblong post receiver 41O through which an oblong head 18PH of first anchor post 18P can pass as suggested in FIG. 8. Then aperture shape changer 50 can be slid back toward cover-motion blocker 80 to an EXTENDED position as suggested in FIG. 9 to decrease the effective size of anchor post-receiver 41A to assume a round shape to create a round post receiver 41RO that is to receive a cylindrical head-support 18S therein but not allow oblong head 18PH to pass therethrough.

Figure 5:
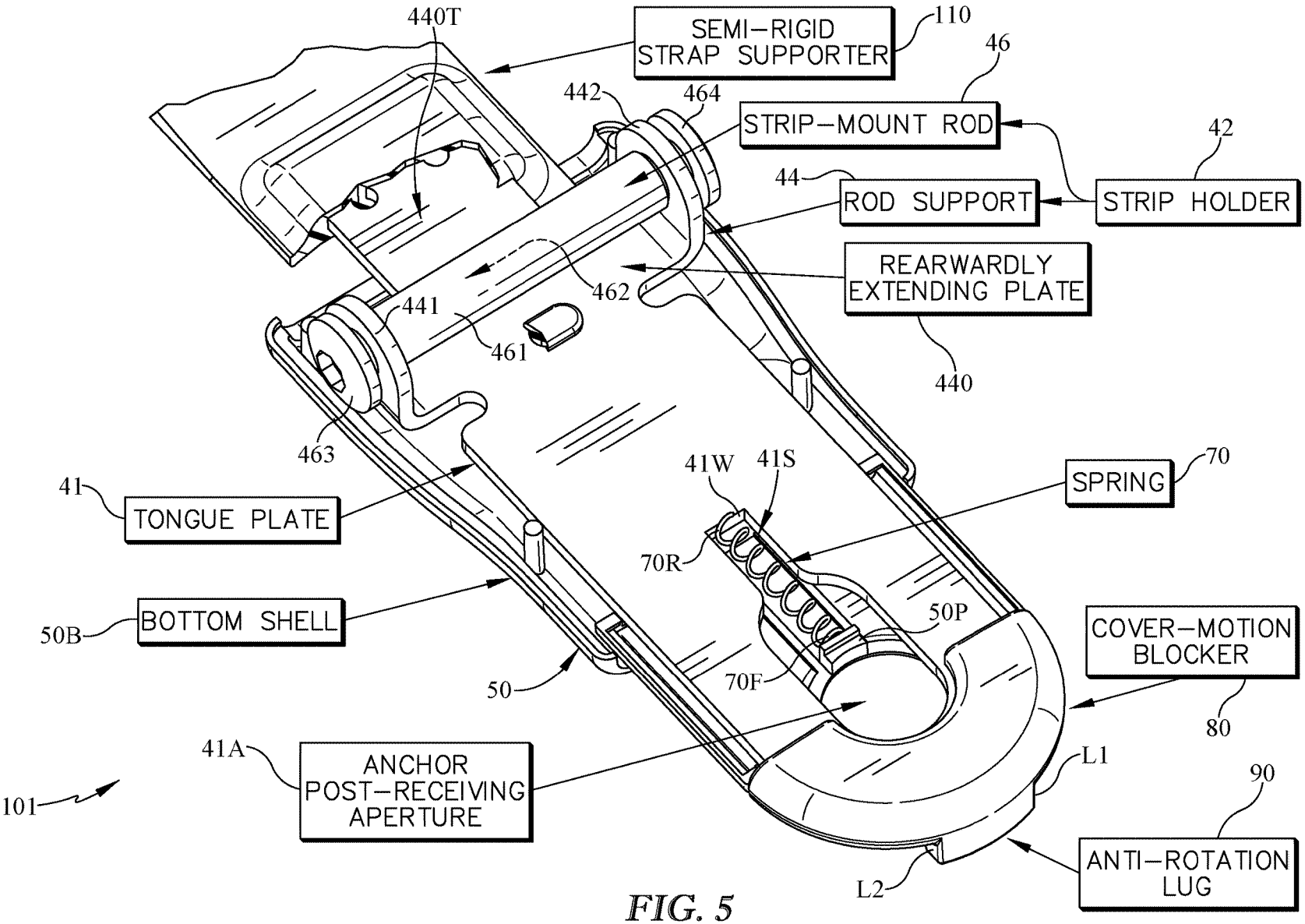
FIGS. 5-5C show an assembly sequence in which the components shown in FIG. 4 along with one end of the anchor-connector carry strip and one end of a semi-rigid strip support that are included in the carry handle and associated with the foot-end first anchor are assembled.

Foundation 40 of foot-end first anchor 101 includes a tongue plate 41 and a strip holder 42 coupled to tongue plate 41 as shown in FIG. 4. Tongue plate 41 is arranged to underlie and support back-and-forth sliding movement of slidable top cover 50T on foundation 40 to vary the effective size and shape of the anchor post-receiving aperture 41A formed in tongue plate 41. Strip holder 42 is configured as shown in FIGS. 4 and 5 to be coupled to anchor-connector carry strip 103 and semi-rigid strap support 110 during assembly of the components included in carry handle 100.

Tongue plate 41 of foundation 40 includes a forward end 41F coupled to cover-motion blocker 80, a rearward end 41R coupled to strip holder 42, and a middle portion 41M formed to include anchor post-receiving aperture 41A and also a spring-receiving aperture 41S that opens into anchor post-receiving aperture 41A as shown, for example, in FIG. 4. Rearward end 41R is cantilevered to strip holder 42 in an illustrative embodiment.

Strip holder 42 of foundation 40 includes a rod support 44 and a strip-mount rod 46 as suggested in FIG. 4. Rod support 44 includes a rearwardly extending plate 440 cantilevered to rearward end 41R of tongue plate 41, a first rod-support flange 441 coupled to one side of plate 440, and a second rod-support flange 442 coupled to an opposite side of plate 440 to lie in spaced-apart parallel relation to first rod-support flange 401 to locate strip-mount rod 46 therebetween as suggested in FIG. 5 Strip-mount rod 46 also includes a first pin retainer 463 coupled to one end of roller-sleeve pin 462 and a second pin retainer 464 coupled to an opposite end of roller-sleeve pin 462 as shown in FIG. 4 rearwardly extending plate 440 is coupled to semi-rigid strap support 110 as shown in FIG. 5.

Figure 4A:
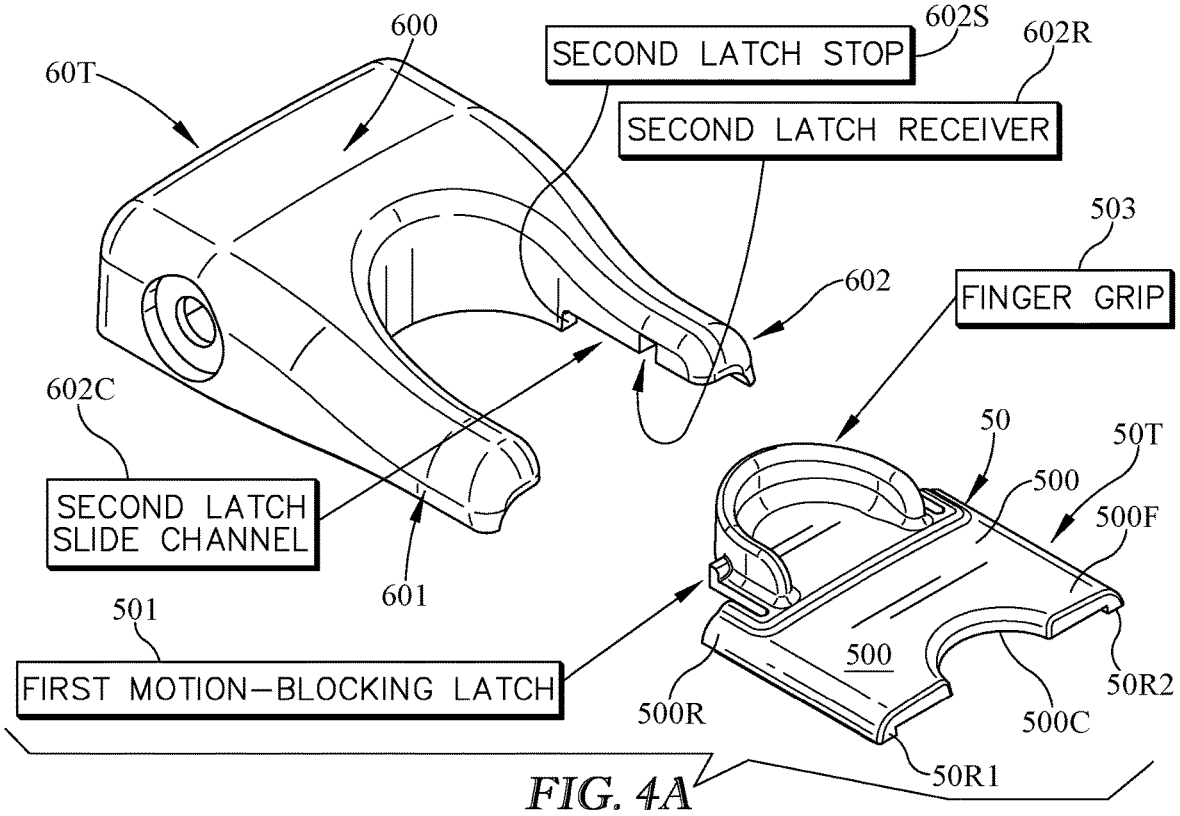
FIG. 4A is an enlarged view of the top shell and the slidable top cover of FIG. 4 showing that the top shell is formed to include a second latch receiver and a second latch slide channel terminating in a second latch stop and showing that the slidable top cover includes a C-shaped finger grip and a first motion-blocking latch arranged to lie along a first side of the C-shaped finger grip.
Figure 4B:
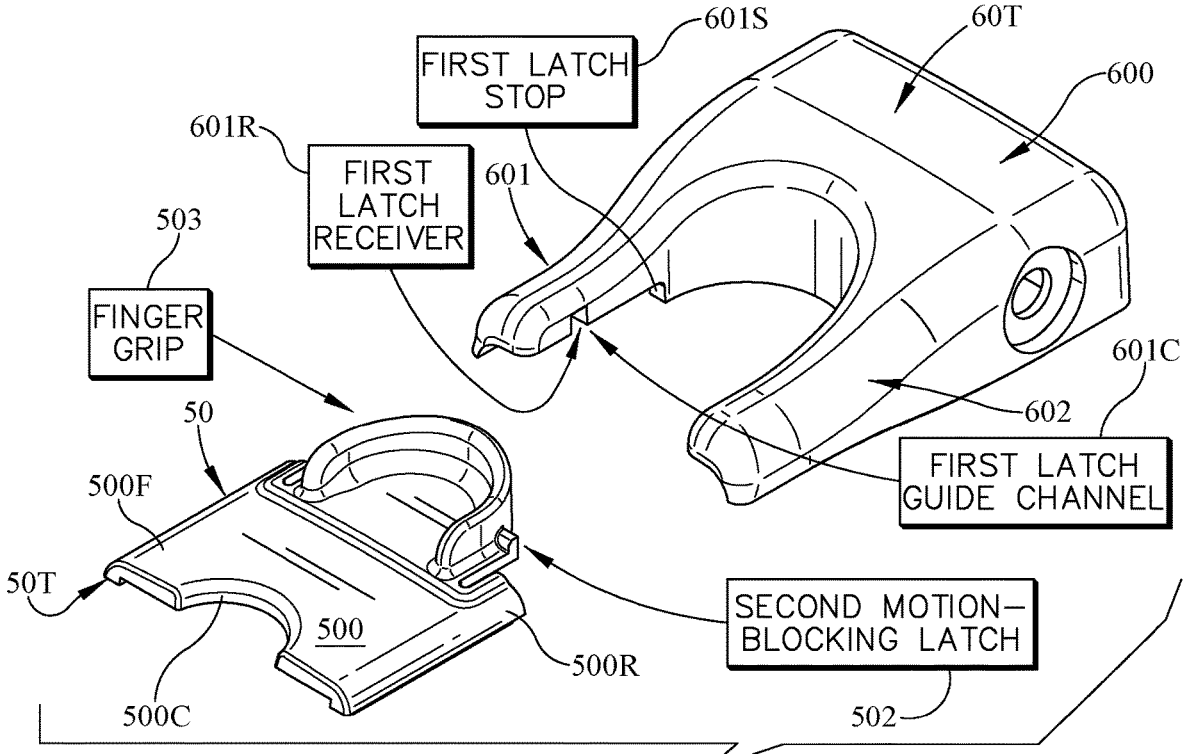
FIG. 4B is a perspective view similar to FIG. 4A taken from a different point of view showing that the top shell is formed to include a first latch receiver and a first latch slide channel communicating with the first latch receiver and terminating in a first latch stop and showing that the slidable top cover further includes a second motion-blocking latch arranged to lie along a second side of the C-shaped finger grip.

Slidable top cover 50T of aperture shape changer 50 includes a slide plate 500, a first motion-blocking latch 501 coupled to one side of slide plate 500, a second motion-blocking latch 502 coupled to an opposite side of slide plate 500, and a C-shaped finger grip 503 coupled to slide plate 500 and located between first and second motion-blocking latches 501, 502 as shown in FIGS. 4, 4A, and 4B. Slide plate 500 includes a forward end 500F formed to include a concave edge 500C and a rearward end 500R coupled to latches 501, 502 and finger grip 503. Slide plate 500 also includes side rails 50R1, 50R2 for slidably engaging spaced-apart parallel perimeter edges of tongue plate 41.

Figure 5A:
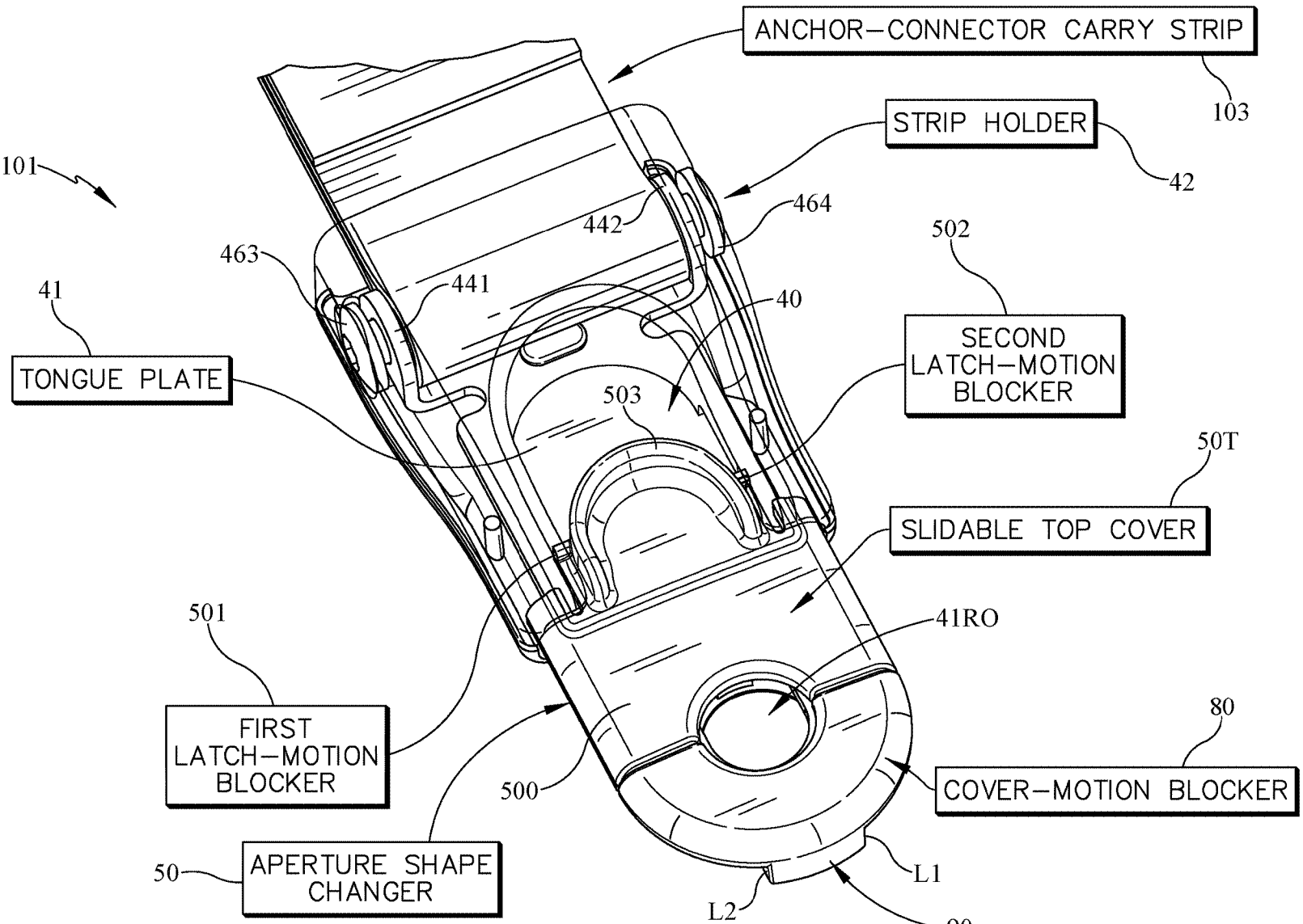
FIG. 5A is a perspective view showing that the top-connector carry strip has been coupled to the strip-mount rod of the strip holder and the slidable top cover and the stationary cover-motion blocker have been mounted on the tongue plate of the foundation.

Top-cover slide guide 60 includes a top shell 60T and a companion bottom shell 60B as shown in FIG. 4. Top and bottom shells 60T, 60B mate to trap strip holder 42 of foundation 40 therebetween as shown in FIG. 5A. Top shell 60T includes a first leg 601 that is formed to include a downwardly opening first latch receiver 601R and a downwardly opening first latch slide channel 601C communicating with first latch receiver 601R as shown in FIG. 4B and also a second leg 602 that is formed to include a downwardly opening second latch receiver 602R and a downwardly opening second latch slide channel 602C communicating with second latch receiver 602R as shown in FIG. 4A. Top shell 60T also includes a waist 600 coupled to each of first and second legs 601, 602 as shown in FIG. 4. Bottom shell 60B is configured to mate with undersides of first and second legs 601, 602 of top shell 60T as suggested in FIGS. 4 and 5A.

Slidable bottom cover 50B of aperture shape changer 50 is coupled to slide plate 500 of slidable top cover 50T to slide back-and-forth therewith on tongue plate 41. Slidable bottom cover 50B includes a floor plate 50F and an upstanding spring-engagement pad 50P coupled to floor 50F as shown in FIG. 4.

Spring 70 includes a forward end 70F arranged to engage spring-engagement pad 50P of slidable bottom cover 50B and a rearward end 70R arranged to engage a spring wall 41W included in tongue plate 41 of foundation 40. Spring 70 is a compression spring that is arranged to extend into and lie in spring-receiving aperture 41S formed in tongue plate 41.

A series of perspective views are provided in FIGS. 6-11 to illustrate a PUSHDOWN-PULLBACK-MOUNT-RELEASE-AND-TURN process in accordance with the present disclosure for mating foot-end first anchor 101 of carry handle 100 to the first anchor post 18P that is mounted on foot-end 18 of infant excursion seat 10. This process is also used in accordance with the present disclosure to mate head-end second anchor 102 of carry handle 100 to the second anchor post 20P that is mounted on head end 20 of infant excursion seat 10.

First anchor post 18P on the foot end 18 of the infant excursion seat 10 includes an oblong head 18PH coupled to a distal end 18PS1 of a cantilevered head-support shaft 18PS that is rooted on a raised rotation-blocker platform 18RBP that is arranged to lie alongside a U-shaped anti-rotation-lug guide 18G as shown in more detail in FIGS. 12 and 13. Foot-end first anchor 101 is shown in FIG. 6 before it is mated with the first anchor post 18P to couple one end of the carry handle 100 to the foot end 18 of the infant excursion seat 10. Rotation-blocker platform 18RBP also includes a first stop S1 and a second S2 that are arranged to lie in spaced-apart rotation to one another as shown in FIGS. 12 and 13 and function to establish rotation-limit positions and block rotation of foot-end first anchor 101 about axis of rotation 100A as suggested in FIGS. 14-17.

Figures 6A, 6B, 6C:
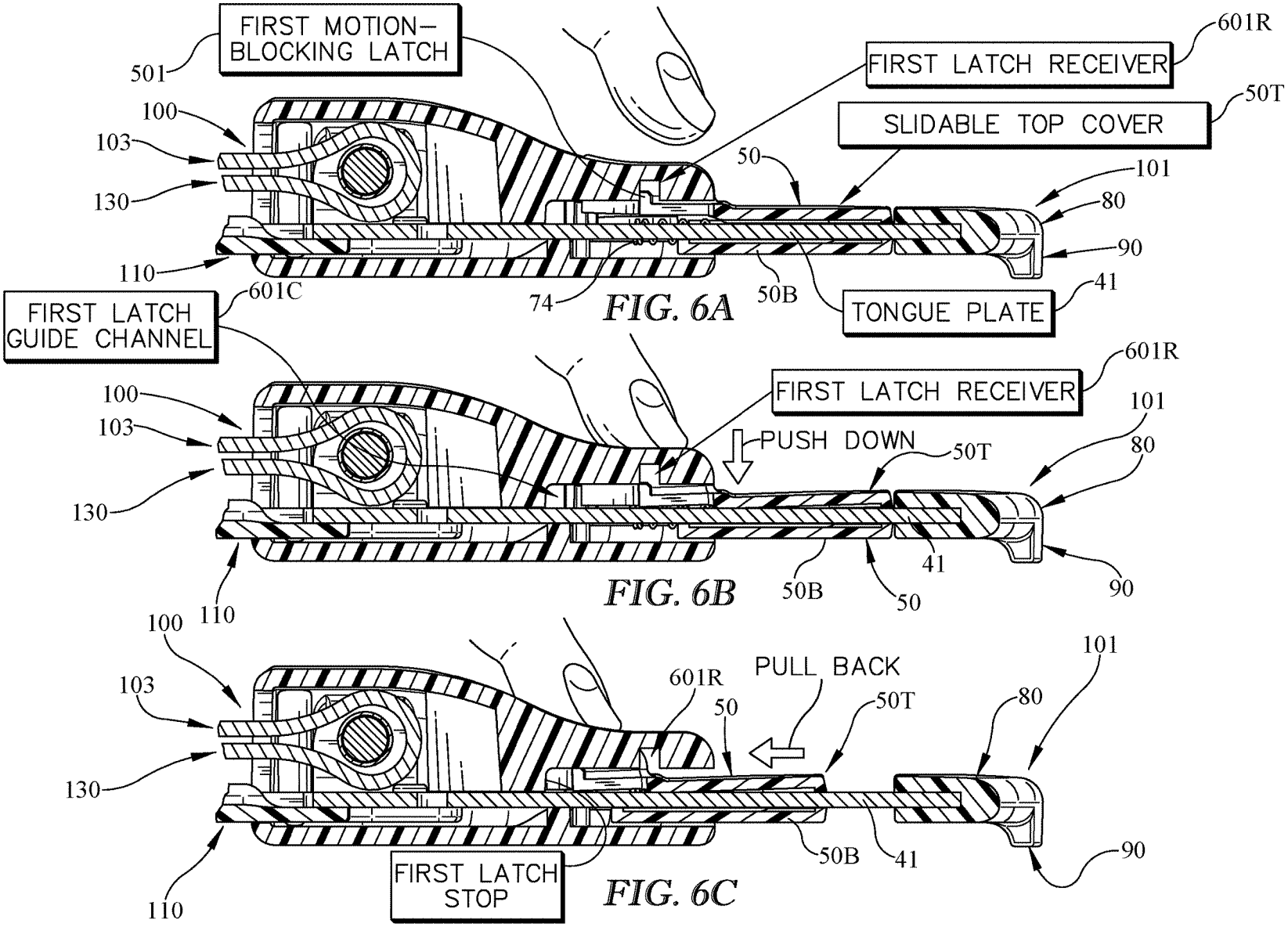
FIGS. 6A-6C illustrate an illustrative initial PUSH-DOWN step that can be included in a post-mating process in accordance with the present disclosure in which a user applies a pushdown force to a portion of the retractable slidable top cover of the spring-biased aperture shape changer as shown in FIG. 6B to cause an upstanding motion-blocking first latch included in that slidable top cover to move downwardly toward the tongue plate of the foundation to exit a downwardly opening latch receiver formed in a top shell of the foot-end first anchor to free the retractable spring-biased aperture shape changer to be retracted (i.e slid rearwardly toward the strip holder) to compress the compression spring associated with the spring-biased aperture shape changer during a subsequent PULL-BACK step in accordance with the present disclosure as shown in FIGS. 6C and 7.

An illustrative initial PUSHDOWN step is shown in FIGS. 6A-6C and can be included in a post-mating process in accordance with the present disclosure to allow a user to apply a pushdown force to a portion of the retractable spring-biased slidable top cover 50T of aperture shape changer 50 as shown in FIG. 6B to cause a first upstanding latch 501 included in that top cover 50T to move downwardly to exit a downwardly opening latch receiver 601R formed in a top shell 60T of the foot-end anchor 101 while aperture shape changer 50 occupies the EXTENDED position to free the retractable spring-biased slidable top cover 50T to be retracted to compress the compression spring 70 associated with the slidable top cover 50T of the spring-biased aperture shape changer 50 during a subsequent PULLBACK step in accordance with the present disclosure as shown in FIGS. 6C and 7.

Figure 8:
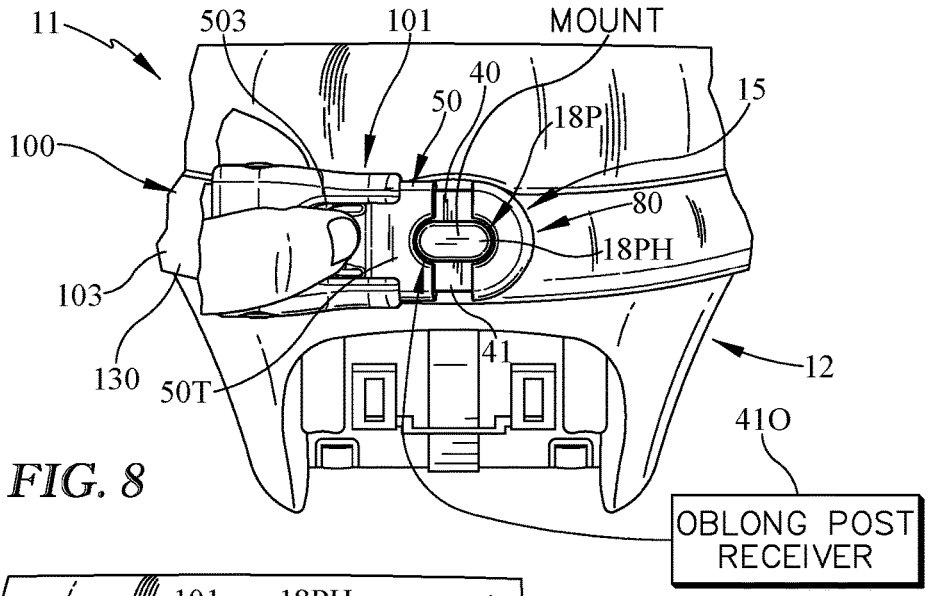

A first PULLBACK step in a post-mating process in accordance with the present disclosure is shown in FIG. 7 in which a round post receiver 41RO formed in the foot-end anchor 101 as shown in FIG. 6 is expanded to generate an oblong post receiver 41O sized to receive the oblong head 18PH as shown in FIG. 8 in response to sliding retracting movement of a slidable top cover 50T of spring-biased aperture shape changer 50 in a rearward direction away from a companion C-shaped end piece 80 to the RETRACTED position to change the shape of the post receiver 141A provided in the first foot-end anchor 101.

Figure 9:
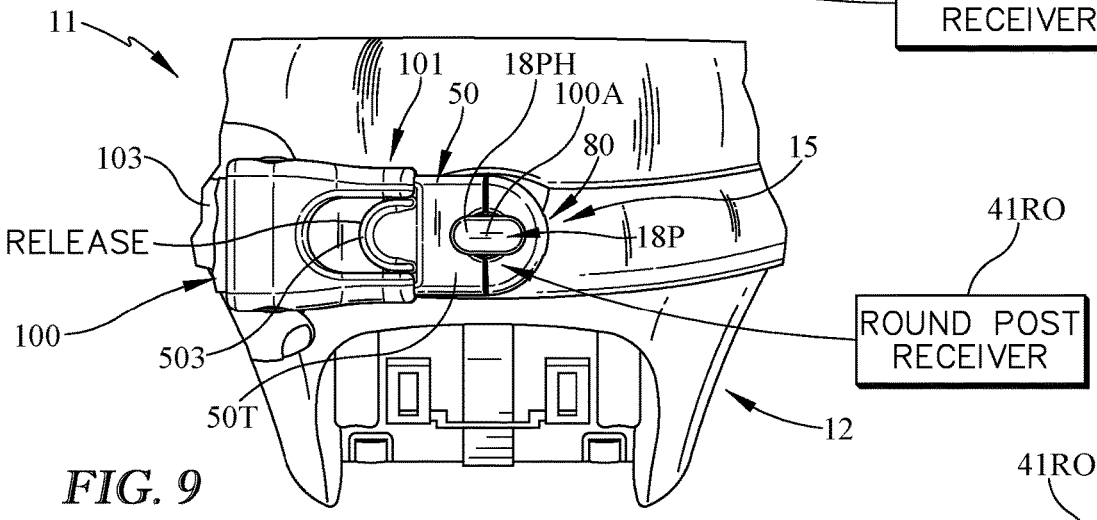

The user has moved the foot-end first anchor 101 toward the first anchor post 18P to cause the oblong head 18PH of the first anchor post 18P as shown in FIG. 8 to fit in the temporarily expanded oblong post receiver 41O formed in the foot-end first anchor 101. Foot-end first anchor 101 has been moved toward the foot end 18 of the infant excursion seat 10 as shown in FIG. 9 to cause the oblong head 18PH of the first anchor post 18P to pass through the temporarily expanded oblong post receiver 41O formed in the foot-end anchor 101 during a subsequent MOUNT step in the post-mating process in accordance with the present disclosure that takes place in an initial stage of mating engagement of the mobile foot-end first anchor 101 of the carry handle 100 with the stationary first anchor post 18P that is coupled to foot end 18 of infant excursion seat 10.

Figure 10:
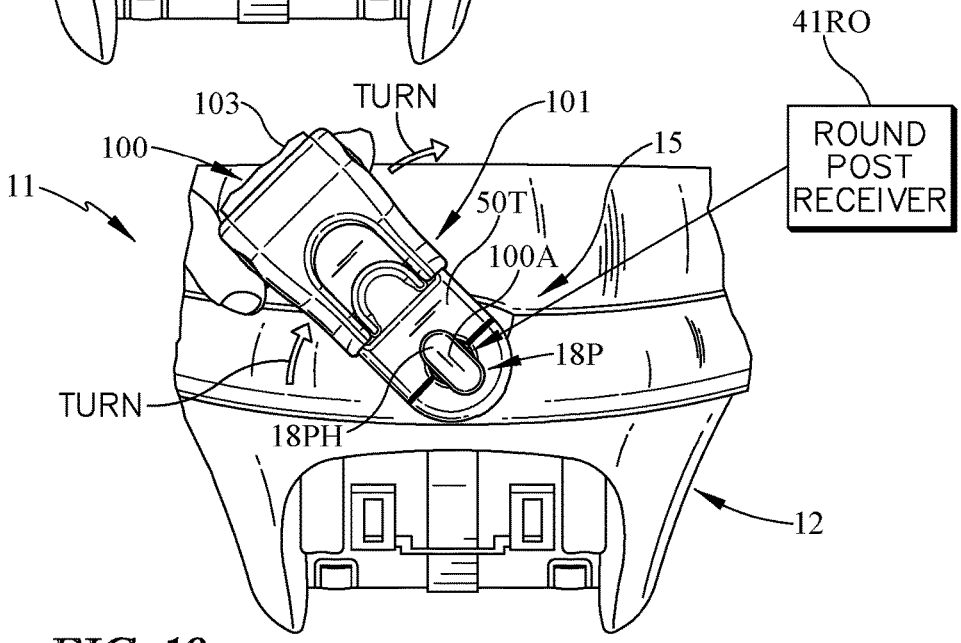

Both of the RELEASE and TURN steps in the post-mating process in accordance with the present disclosure are shown in FIG. 10. These steps take place in subsequent stages of mating engagement of foot-end first anchor 101 of carry handle 100 with the first anchor post 18P on infant excursion seat 10.

Figure 11:
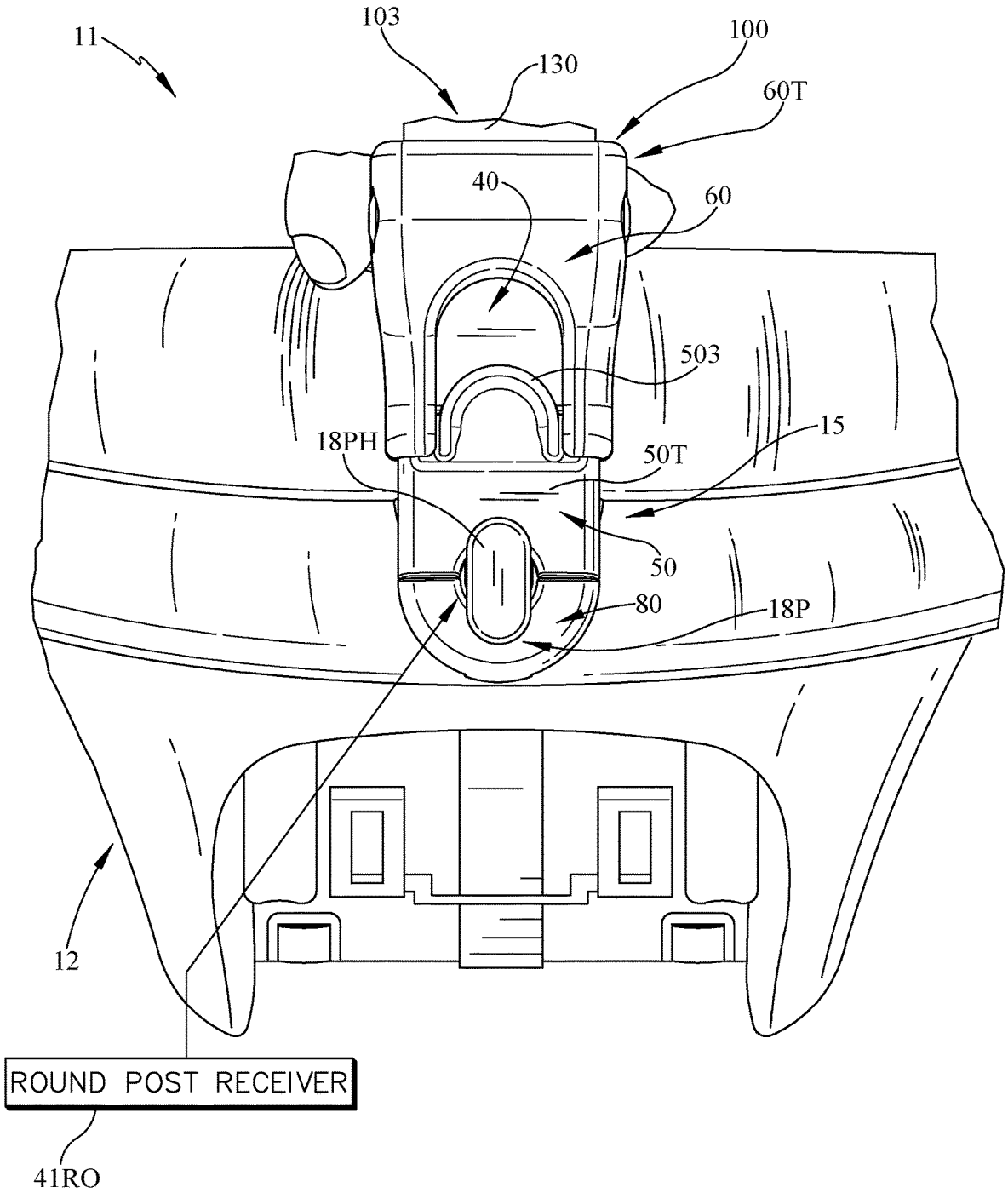

Rotation of foot-end anchor 101 about an axis of rotation 100A established by the head-support shaft 18PS of first anchor post 18P through an angle of about 90° during a TURN step in the post-mating process in accordance with the present disclosure is shown in FIG. 11. Spring-biased movement of the slidable top cover 50T of aperture shape changer 50 in a forward direction toward a companion C-shaped end piece 80 functions to change the temporarily expanded oblong post receiver 41O back to the original round post receiver 41RO shown in FIG. 6 during a RELEASE step in the post-mating process in accordance with the present disclosure.

Figure 15:
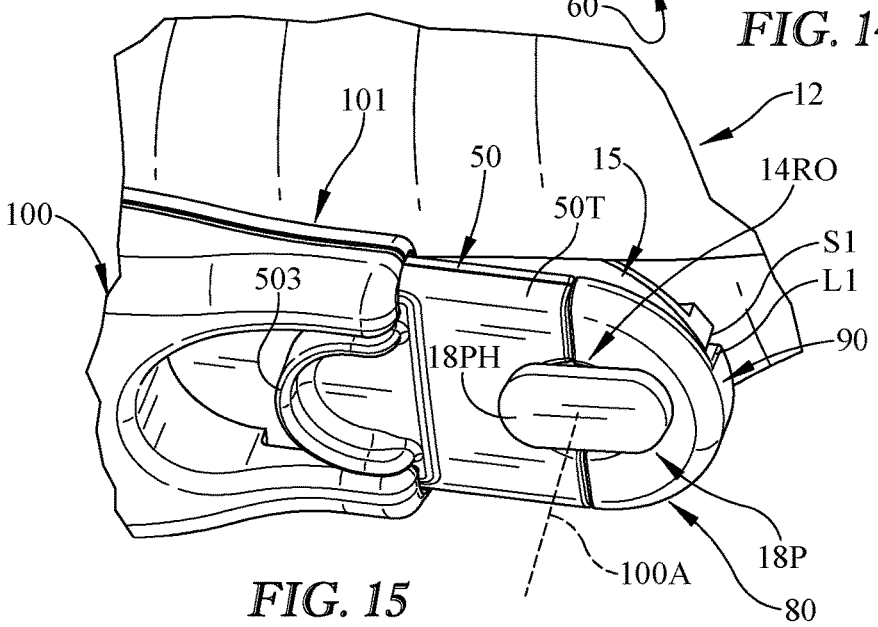
FIG. 15 is an enlarged view of the foot-end first anchor of FIG. 14.

Counter-clockwise rotation of end-mounted carry handle 100 is shown in FIG. 14 about the axis of rotation 100A that extends through the first anchor post 18P from an UPRIGHT USE position shown in FIGS. 1 and 2 to a FIRST-SIDE STORAGE position alongside a first side of infant excursion seat 10. Rotation of foot-end first anchor 101 in a counter-clockwise direction about axis of rotation 100A from the UPRIGHT USE position shown in FIGS. 1 and 2 to the FIRST-SIDE STORAGE position is limited by engagement of one side L1 of anti-rotation lung 90 and first stop S1 on rotation-blocker platform 18RBP as shown in FIGS. 14 and 15.

Figure 16:
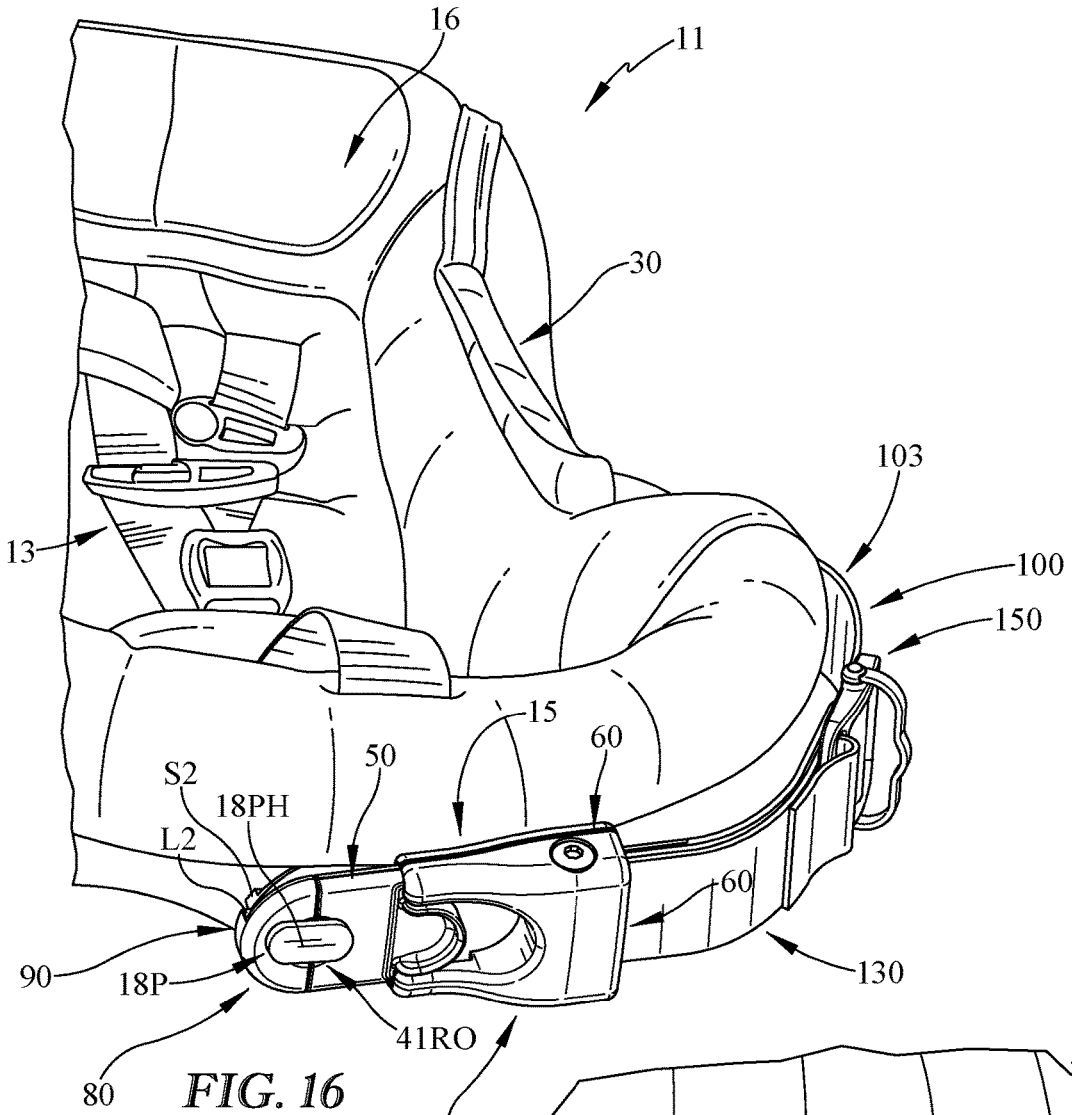
FIG. 16 is a perspective view of another portion of the infant excursion seat of FIGS. 1 and 2 showing clockwise rotation of the foot-end first anchor and the foot-end first anchor and the carry handle about the axis of rotation that extends through the first anchor post from the UPRIGHT USE position shown in FIGS. 1 and 2 to a SECOND-SIDE STORAGE position alongside a second side of the infant excursion seat.
Figure 17:
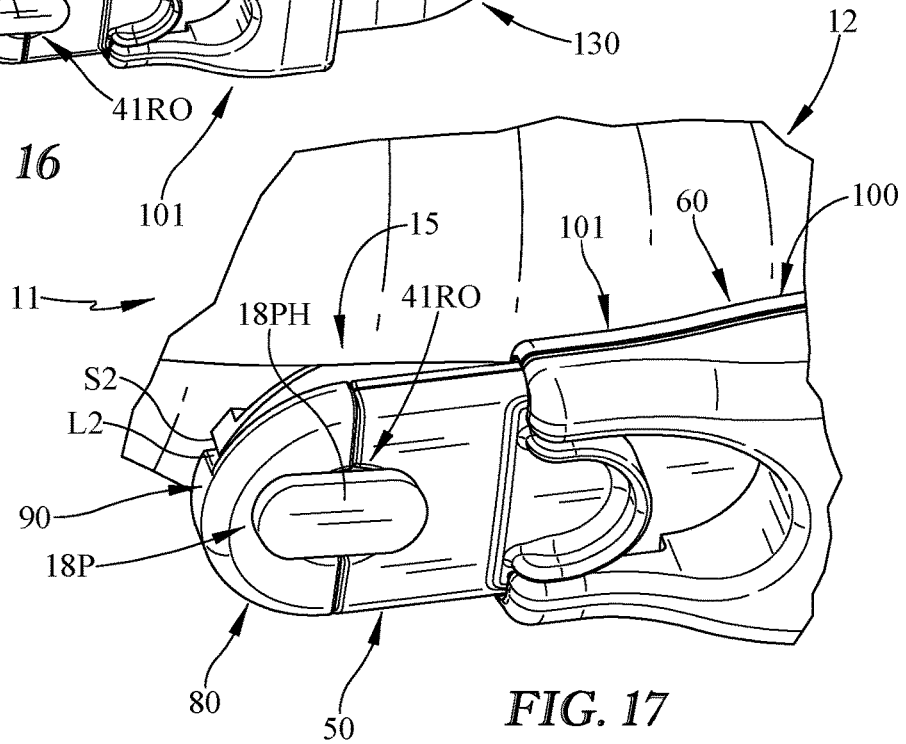
FIG. 17 is an enlarged view of the foot-end first anchor of FIG. 16.

Clockwise rotation of end-mounted carry handle 100 is shown in FIG. 16 about the axis of rotation 100A that extends through the first anchor post 18P from the UPRIGHT USE position shown in FIGS. 1 and 2 to a SECOND-SIDE STORAGE position alongside a second side of infant excursion seat 10. Rotation of foot-end first anchor 101 in a clockwise direction about axis of rotation 100A from the UPRIGHT USE position shown in FIGS. 1 and 2 to the SECOND-SIDE STORAGE position is limited by engagement of an opposite side L2 of anti-rotation lug 90 and second stop S2 on anti-rotation blocker platform 18RBP as shown in FIGS. 16 and 17.

A carry handle anchor system 15 in accordance with the present disclosure is shown in FIGS. 1-4 and used to anchor a carry handle 100 to the object to be carried as shown in FIGS. 1 and 12. Carry handle anchor system 15 includes a first anchor post 18P adapted to be coupled to an object to be carried. Carry handle anchor system 15 also includes a carry handle 100 comprising a carry strip 103 and a first anchor 101 coupled to a first end of carry strip 103.

In the illustrated embodiment, the object to be carried is an infant excursion seat 10 as shown in FIG. 1. Infant excursion seat 10 and carry handle 100 cooperate to corm a child restraint 11 as shown in FIG. 1.

First anchor post 18P includes a head-support shaft 18PS having a proximal end 18PS1, an opposite distal end 18PS3, and a medial segment 18PS2 therebetween as shown in FIG. 13. First anchor post 18P also includes an oblong head 18PH coupled to the distal end 18PS3 of head-support shaft 18PS.

First anchor 101 includes a foundation 40 formed to include an oblong anchor post-receiving aperture 41A that has an oblong shape as shown in FIG. 4. Oblong anchor post-receiving aperture 41A is sized to allow passage of oblong head 18PH of first anchor post 18P therethrough during mating of first anchor 101 to first anchor post 18P and separation of first anchor 101 from first anchor post 18P as suggested in FIGS. 7 and 8. First anchor 101 also includes an aperture shape changer 50 mounted on foundation 40 for sliding movement between a RETRACTED position exposing the oblong anchor post-receiving aperture 41A as shown in FIG. 7 to allow relative movement of oblong head 18PH of first anchor post 18P in a first direction through the oblong anchor post-receiving aperture 41A to position medial segment 18PS2 of head-support shaft 18PS in the oblong anchor post-receiving aperture 41A as suggested in FIGS. 8 and 9 during mating of first anchor 101 to first anchor post 18P and during separation of first anchor 101 from first anchor post 18P and an EXTENDED position decreasing the size of the oblong anchor post-receiving aperture 41A temporarily to a relatively smaller effective shape and size as shown in FIGS. 6 and 9 to block relative movement of oblong head 18PH of first anchor post 18P in an opposite second direction through the oblong anchor-post receiving aperture 41A formed in foundation 40 of first anchor 101 while medial segment 18PS2 of head-support shaft 18PS remains in the oblong anchor post-receiving aperture 41A to retain first anchor 101 in mating engagement to first anchor post 18P and block separation of first anchor 101 from first anchor post 18P.

Figure 5B:
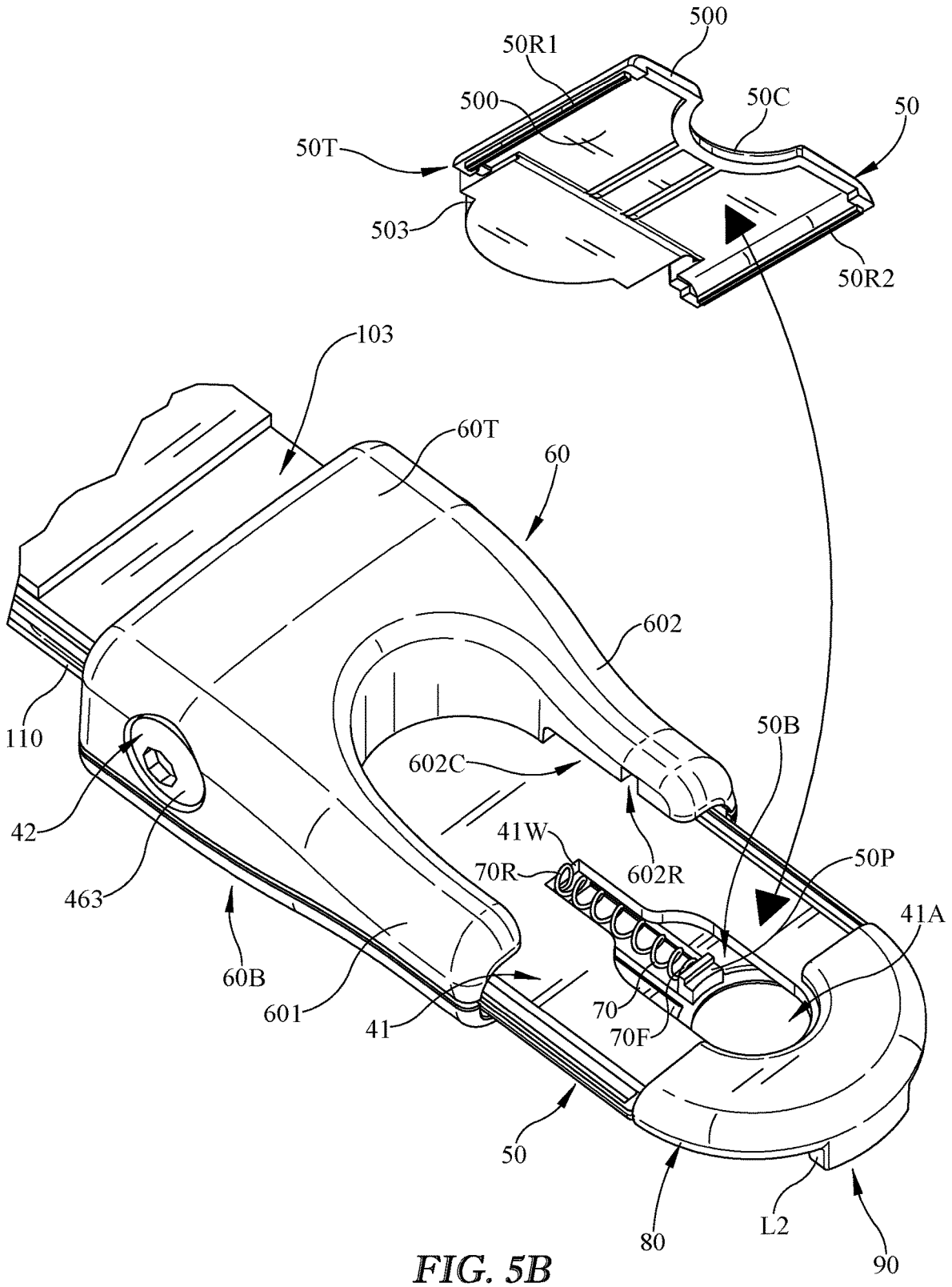
FIG. 5B is a partly exploded perspective assembly view of the components shown in FIG. 4 showing that the slidable top cover of FIG. 4 has been removed to show a portion of the underlying tongue plate and the aperture shape changer-biasing spring that has a forward end in engagement with a spring-engagement pad included in the slidable bottom cover that underlies the tongue plate and is configured to be mated to the slidable top cover to move in unison therewith relative to the tongue plate.
Figure 5C:
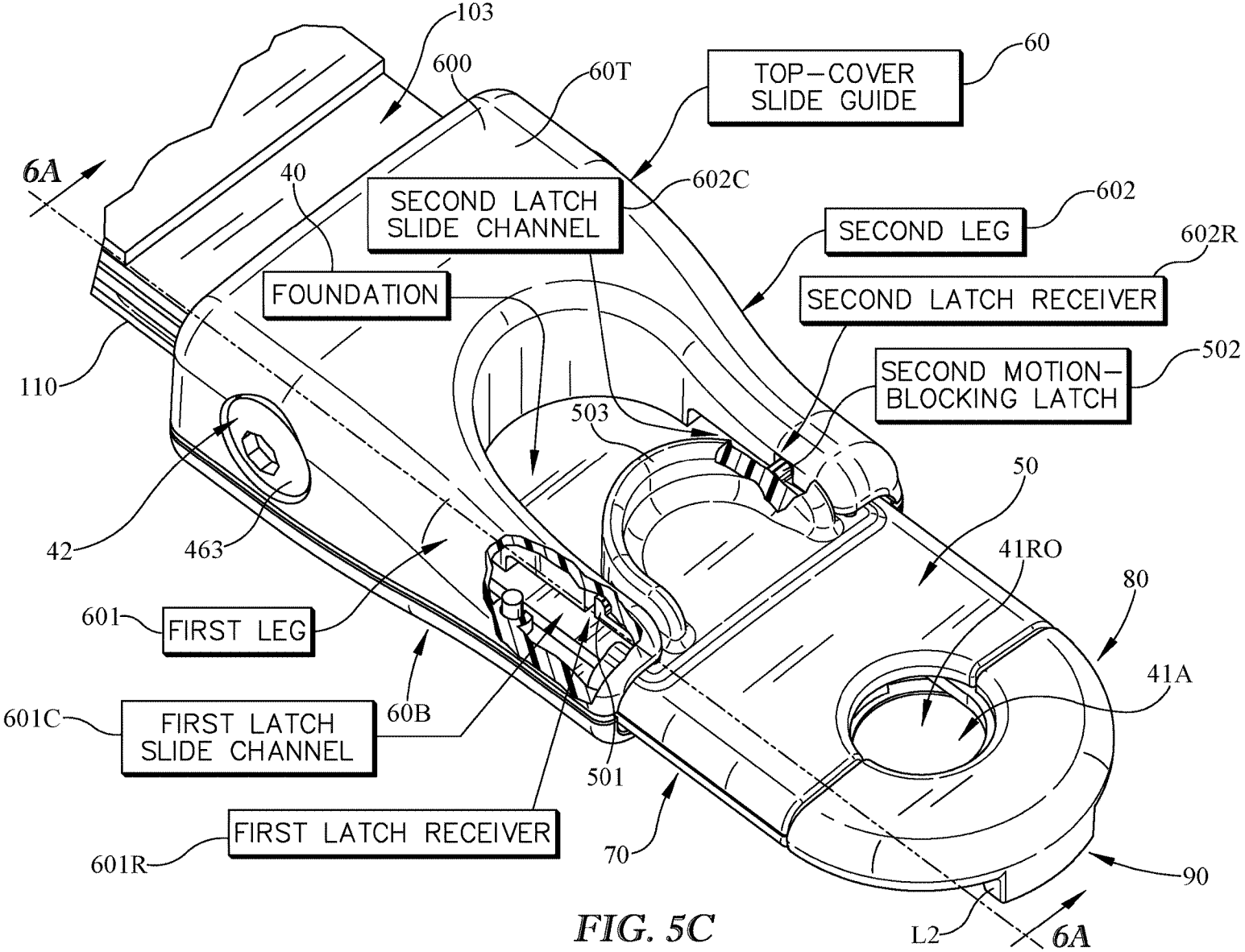

First anchor 101 further includes a spring 70 for yieldably urging aperture shape changer 50 normally to the EXTENDED position as suggested in FIGS. 5B and 5C. Spring 70 is a compression spring 70 arranged to act between foundation 40 and aperture shape changer 50.

Aperture shape changer 50 includes a slidable top cover 50T and a slidable bottom cover 50B as shown in FIG. 4. Slidable top cover 50T is arranged to lie above foundation 40 and configured to include a finger grip 503 extending upwardly away from foundation 40. Slidable bottom cover 50B is arranged to lie below foundation 40 and coupled to slidable top cover 50T to move therewith relative to foundation 40. Compression spring 70 includes a rearward end that acts against foundation 40 and a forward end that acts against slidable bottom cover 50B normally to yieldably urge aperture shape changer 50 to the EXTENDED position.

Foundation 40 of first anchor 101 includes a tongue plate 41 that is formed to include the oblong anchor post-receiving aperture 41A and a spring-receiver aperture 41S opening into the oblong anchor post-receiving aperture 41A as shown in FIG. 4. Slidable bottom cover 50B includes a floor 50F arranged to lie under tongue plate 41 and an upstanding spring-engagement pad 50P coupled to floor 50F and arranged to extend upwardly toward slidable top cover 50T. Compression spring 70 is arranged to extend into the spring-receiver aperture 41S formed in tongue plate 41 and includes a rearward end 70R in engagement with an edge of tongue plate 41 bordering spring-receiver aperture 41S and a forward end 70F in engagement with upstanding spring-engagement pad 50P of slidable bottom cover 50B as shown in FIG. 5.

Slidable top cover 50T includes a slide plate 500 arranged to slide over a topside of tongue plate 41, a first motion-blocking latch 501 coupled to one side of slide plate 500, and a second motion-blocking latch 502 coupled to an opposite side of slide plate 500*a* shown in FIG. 4. Finger grip 503 is coupled to slide plate 500 to lie between first and second motion-blocking latches 501, 502.

First anchor 101 further includes a top-cover slide guide 60 coupled to foundation 40 as suggested in FIGS. 4 and 5B. Top-cover slide guide 60 is formed to include a first leg 601 associated with first motion-blocking latch 501, and a second leg 602 associated with second motion-blocking latch 502. Second leg 602 is arranged to lie in spaced-apart relation to the first leg 601 to form a finger-grip receiver channel 503C therebetween sized to receive the finger grip 503 of slidable top cover 50T when aperture shape changer 50 occupies each of the RETRACTED and EXTENDED positions.

First leg 601 is formed to include a downwardly opening first latch receiver 601R oriented to receive first motion-blocking latch 501 upon arrival of aperture shape changer 50 in the EXTENDED position to block further movement of slidable top cover 50T relative to foundation 40 as suggested in FIGS. 4B and 5C. First leg 601 is also formed to include a first latch slide channel 601C communicating with the downwardly opening first latch receiver 601R and extending from first latch receiver 601R in a direction away from the oblong anchor post-receiving aperture 41A formed in foundation 40 as suggested in FIG. 4A to receive first motion-blocking latch 501 therein during movement of aperture shape changer 50 from the EXTENDED positon to the RETRACTED position after downward movement of first motion-blocking latch 501 toward tongue plate 41 of foundation 40 to exit first latch receiver 601R as suggested in FIG. 5C1 and enter first latch slide channel 601C as suggested in FIG. 5C2.

Second leg 602 is formed to include a downwardly opening second latch receiver 602R oriented to receive second motion-blocking latch 502 upon arrival of aperture shape changer 50 in the EXTENDED position to block further movement of slidable top cover 50T relative to foundation 40 as suggested in FIGS. 4A and 5C. Second leg 602 is also formed to include a second latch slide channel 602C communicating with the downwardly opening second latch receiver 602R and extending from second latch receiver 602R in a direction away from the oblong anchor post-receiving aperture 41A formed in foundation 40 as suggested in FIG. 4A to receive second motion-blocking latch 502 therein during movement of aperture shape changer 50 from the EXTENDED positon to the RETRACTED position after downward movement of second motion-blocking latch 502 toward tongue plate 41 of foundation 40 to exit second latch receiver 602R as suggested in FIG. 5C1 and enter second latch slide channel 602C as suggested in FIG. 5C2.

Tongue plate 41 of foundation 40 is formed to include oblong anchor post-receiving aperture 41A and arranged to support aperture shape changer 50 for back-and-forth sliding movement relative as suggested in FIG. 4 to oblong anchor post-receiving aperture 41A between the RETRACTED and EXTENDED positions to change the effective shape of oblong anchor post-receiving aperture 41A as suggested in FIGS. 6 and 7. Tongue plate 41 includes a rearward end coupled to strip holder 42 and a forward end arranged to lie in spaced-apart relation to the rearward end to locate the oblong anchor post-receiving aperture 41A therebetween.

Foundation 40 of first anchor 101 also includes a strip holder 42 appended to rearward end of tongue plate 41 as suggested in FIG. 4. Strip holder 42 is arranged to lie in a hollow cavity formed in top-cover slide guide 60 as suggested in FIG. 5B coupled to an anchor mount provided at a distal end 18PS3 of carry strip 103 to tether carry strip holder 42 as suggested I FIG. 5B to first anchor 101.

First anchor 101 further includes a cover-motion blocker 80 coupled to forward end of tongue plate 41 as suggested in FIGS. 4 and 5. Cover-motion blocker 80 is formed to include a rearwardly facing concave wall arranged to extend around a forward end of oblong anchor post-receiving aperture 41A. First anchor 101 also includes a spring 70 arranged to act against foundation 40 and aperture shape changer 50 normally to yieldably urge the aperture shape changer 50 along tongue plate 41 in a forward direction to engage cover motion blocker 80 to establish the EXTENDED position and to cause a forwardly facing concave end edge of aperture shape changer 50 to cooperate with the rearwardly facing concave wall of cover motion blocker 80 to form a round passageway 41RO therebetween sized to establish the relatively smaller effective shape of oblong anchor post-receiving aperture 41A and to receive medial segment 18PS2 of head-support shaft 18PS therein.

Carry strip 103 of carry handle 100 is flexible. Carry handle 100 further includes a semi-rigid support 110 arranged to lie in side-by-side mating engagement with an underside of a strap section of carry strip 103 as suggested in FIG. 3. Foundation 40 further includes a rearwardly extending tab 440T that is coupled to strip holder 42 to locate strip holder 42 between the rearwardly extending tab 440T and tongue plate 41 as shown in FIG. 4. Semi-rigid support 110 is coupled to the rearwardly extending tab 440T to support and rigidify the flexible carry strip 103 positioned to lie on a topside of semi-rigid support 110 along a rigidified path extending away from the rearwardly extending plate 440.

Tongue plate 41 is formed to include a spring-receiver aperture 41S that opens into oblong anchor post-receiving aperture 41A as shown in FIG. 4. Compression spring 70 includes a rearward end 70R that is located in the spring-receiver aperture 41S and an opposite forward end 70F that is arranged to lie in the oblong anchor post-receiving aperture 41A when anchor shape changer 50 occupies the EXTENDED position as shown in FIG. 5 and to lie in the spring-receiver aperture 41S when anchor shape changer 50 occupies the RETRACTED position as suggested in FIG. 7.

Foundation 40 includes an inner perimeter edge (E) that defines the boundary of the oblong anchor post-receiving aperture 41A. Inner perimeter edge (E) includes, in series, an inner concave surface (E1), a first side surface (E2), an outer concave surface (E3), and a second side surface (E4) as shown in FIG. 4.

Aperture shape changer 50 includes a slidable top cover 50T that includes a forward end 50TF that is formed to include a concave end edge that is aligned to lie in registry with inner concave surface (E1) of inner perimeter edge (E) of the foundation 40 when aperture shape changer 50 occupies the RETRACTED position. Forward end 50TF of slidable top cover 50T is arranged to lie in spaced-apart opposing relation to outer concave surface (E3) of inner perimeter edge (E) cooperatively to decrease the effective shape and size of oblong anchor post-receiving aperture 41A to establish a temporary round shape 41RO of the oblong anchor post-receiving aperture 41A sufficient in size to receive a portion of medial segment 18PS2 of head-support shaft 18PS of first anchor 101 therein and to block movement of oblong head 18PH of first anchor post 18P in the opposite second direction through the oblong anchor post-receiving aperture 41A formed in foundation 40 of first anchor 101 when aperture shape changer 50 occupies the EXTENDED position.

Slidable top cover 50T includes a slide plate 500 formed to include the concave end edge at the forward end 500F thereof. Finger grip 503 is located at an opposite rearward end 500R of slide plate 500 as shown in FIG. 4. Finger grip 503 is configured to provide means for engaging a finger of a user moving along slide plate 500 in a rearward direction from forward end 500F of slide plate 500 toward rearward end 500R to move aperture shape changer 50 from the EXTENDED positon to the RETRACTED position to expose the oblong anchor post-receiving aperture 41A formed in foundation 40 so that oblong head 18PH of first anchor post 18P of the object to be carried can be passed by the user in the first direction through oblong anchor post-receiving aperture 41A to locate medial segment 18PS2 of head-support shaft 18PS of first anchor post 18P in oblong anchor post-receiving aperture 41A during mating of first anchor 101 of the carry handle 100 to first anchor post 18P of the object 10 to be carried.

Aperture shape changer 50 further includes a slidable bottom cover 50B arranged to lie in spaced-apart relation to slidable top cover 50T to locate a portion of foundation 40 therebetween and coupled to slidable top cover 50T to move therewith relative to foundation 40 during movement of aperture shape changer 50 between the RETRACTED and EXTENDED positions. First anchor 101 further includes spring means 70 for yieldably urging the slidable bottom cover 50B in a forward direction to cause simultaneous movement of slidable top cover 50T and slidable bottom cover 50B in the forward direction so as to cause aperture shape changer 50 normally to assume the EXTENDED position to decrease the effective shape and size of oblong anchor post-receiving aperture 41A.

Spring 70 is arranged to act between foundation 40 and aperture shape changer 50 normally to move aperture shape changer 50 in the forward direction toward outer concave surface of perimeter edge (E) that defines the boundary of the oblong anchor post-receiving aperture 41A formed in foundation 40 to locate aperture shape changer 50 normally in the EXTENDED position.

Aperture shape changer 50 of first anchor 101 includes a slidable top cover 50T arranged to lie above foundation 40 as suggested in FIG. 4. Slidable top cover 50T is configured to include a finger grip 503 extending upwardly away from foundation 40 and a motion-blocking latch arranged to lie alongside finger grip 503.

First anchor 101 further includes a top-cover slide guide 60 (see FIGS. 4 and 4B) including a leg 601 arranged to overlie foundation 40 and motion-blocking latch 501 during movement of aperture shape changer 50 between the RETRACTED and EXTENDED positions. Leg 601 is formed to include a downwardly opening latch receiver 601R oriented to open toward foundation 40 to receive motion-blocking latch 501 therein upon arrival of aperture shape changer 50 in the EXTENDED position to block further movement of slidable top cover 50T relative to foundation 40.

Leg 601 is also formed as shown in FIG. 4B to include a downwardly opening latch slide channel 601C oriented to open toward foundation 40 and to communicate with latch receiver 601R and arranged to extend away from latch receiver 601R in a rearward direction away from the oblong anchor post-receiving aperture 41A formed in foundation 40 to receive motion-blocking latch 501 therein during movement of aperture shape changer 50 from the EXTENDED position to the RETRACTED positon after downward movement of motion-blocking latch 501 toward foundation 40 to exit latch receiver 601R and enter latch slide channel 601C. Leg 601 is also formed to include a first latch stop means 601S located in rearwardly spaced-apart relation to latch receiver 601R to engage and block rearward movement of motion-blocking latch 501 away from the oblong anchor post-receiving aperture 41A formed in foundation 40 during movement of aperture shape changer 50 from the EXTENDED position toward the RETRACTED position to establish the RETRACTED position of aperture shape changer 50.

First anchor 101 further includes a cover-motion blocker 80 coupled to a forward end of foundation 40 as suggested in FIGS. 4 and 5. Cover-motion blocker 80 is arranged to lie in spaced-apart relation to leg 601 of top-cover slide guide 60 to engage a forward-facing end of slidable top cover 50T during movement of aperture shape changer 50 from the RETRACTED position toward the EXTENDED position to establish the EXTENDED positon of aperture shape changer 50.

First anchor 101 further includes an anti-rotation lug 90 coupled to cover-motion blocker 80 and arranged to extend downwardly below foundation 40 as suggested in FIGS. 4 and 6A. First anchor post 18P further includes a rotation-blocker platform 18RBP coupled to proximal end of head-support shaft 18PS to lie in spaced-apart relation to oblong head 18PH. Rotation-blocker platform 18RBP includes a first stop S1 and a second stop S2 arranged to lie in spaced-apart relation to first stop S1 to locate anti-rotation lug therebetween to allow rotation of first anchor 101 about an axis of rotation 100A established by head-support shaft 18PS of first anchor 101 from an UPRIGHT USE position to a FIRST-SIDE STORAGE position as shown in FIG. 14 in response to rotation of first anchor 101 in a counterclockwise direction through an angle of about 90° to cause a first side L1 of anti-rotation lug 90 to engage first stop S1 of rotation-blocker platform 18RBP as shown in FIG. 15 and from the UPRIGHT USE position to a SECOND-SIDE STORAGE position as suggested in FIG. 16 in response to rotation of first anchor 101 in a clockwise direction through an angle of about 90° to cause an opposite second side L2 of anti-rotation lug 90 to engage second stop of rotation-blocker platform 18RBP as shown in FIG. 17.

The invention claimed is:

1. A carry handle anchor system comprising a first anchor post adapted to be coupled to an object to be carried, the first anchor post including a head-support shaft having a proximal end, an opposite distal end, and a medial segment therebetween and an oblong head coupled to the opposite distal end of the head-support shaft, and a carry handle including a carry strip and a first anchor coupled to a first end of the carry strip, the first anchor including a foundation formed to include an oblong anchor post-receiving aperture that has an oblong shape and is sized to allow passage of the oblong head of the first anchor post therethrough during mating of the first anchor to the first anchor post and separation of the first anchor from the first anchor post and aperture shape changer means mounted on the foundation for sliding movement between a retracted position exposing the oblong anchor post-receiving aperture to allow relative movement of the oblong head of the first anchor post in a first direction through the oblong anchor post-receiving aperture to position the medial segment of the head-support shaft in the oblong anchor post-receiving aperture during mating of the first anchor to the first anchor post and separation of the first anchor from the first anchor post and an extended position decreasing the size of the oblong anchor post-receiving aperture temporarily to a relatively smaller effective shape and size to block relative movement of the oblong head of the first anchor post in an opposite second direction through the oblong anchor-post receiving aperture formed in the foundation of the first anchor while the medial segment of the head-support shaft remains in the oblong anchor post-receiving aperture to retain the first anchor in mating engagement to the first anchor post and block separation of the first anchor from the first anchor post, wherein the aperture shape changer means of the first anchor includes a slidable top cover arranged to lie above the foundation and configured to include a finger grip extending upwardly away from the foundation and a first motion-blocking latch configured to block sliding movement of the slidable top cover from the extended position to the retracted position.

2. The carry handle anchor system of claim 1, wherein the first anchor further includes spring means for yieldably urging the aperture shape changer means normally to the extended position.

3. The carry handle anchor system of claim 2, wherein the spring means is a compression spring arranged to act between the foundation and the aperture shape changer means.

4. The carry handle anchor system of claim 2, wherein the aperture shape changer means further includes a slidable bottom cover arranged to lie below the foundation and coupled to the slidable top cover to move therewith relative to the foundation and the spring means is a compression spring that includes a rearward end that acts against the foundation and a forward end that acts against the slidable bottom cover normally to yieldably urge the aperture shape changer means to the extended position.

5. The carry handle anchor system of claim 4, wherein the foundation of the first anchor includes a tongue plate that is formed to include the oblong anchor post-receiving aperture and a spring-receiver aperture that opens into the oblong anchor post-receiving aperture, the slidable bottom cover includes a floor arranged to lie under the tongue plate and an upstanding spring-engagement pad coupled to the floor and arranged to extend upwardly toward the slidable top cover, and the compression spring is arranged to extend into the spring-receiver aperture formed in the tongue plate and includes a rearward end in engagement with an edge of the tongue plate bordering the spring-receiver aperture and a forward end in engagement with the upstanding spring-engagement pad of the slidable bottom cover.

6. The carry handle anchor system of claim 4, wherein the slidable top cover includes a slide plate arranged to slide over a topside of the foundation, the first motion-blocking latch coupled to one side of the slide plate, and a second motion-blocking latch coupled to an opposite side of the slide plate, and the finger grip is coupled to the slide plate to lie between the first and second motion-blocking latches, and wherein the first anchor further includes a top-cover slide guide coupled to the foundation and formed to include a first leg associated with the first motion-blocking latch, a second leg associated with the second motion-blocking latch and arranged to lie in spaced-apart relation to the first leg to form a finger-grip receiver channel therebetween sized to receive the finger grip of the slidable top cover when the aperture shape changer means occupies each of the retracted and extended positions, wherein the first leg is formed to include a downwardly opening first latch receiver oriented to receive the first motion-blocking latch upon arrival of the aperture shape changer means in the extended position to block further movement of the slidable top cover relative to the foundation and a first latch slide channel communicating with the downwardly opening first latch receiver and extending from the first latch receiver in a direction away from the oblong anchor post-receiving aperture formed in the foundation to receive the first motion-blocking latch therein during movement of the aperture shape changer means from the extended position to the retracted position after downward movement of the first motion-blocking latch toward the foundation to exit the first latch receiver and enter the first latch slide channel, and wherein the second leg is formed to include a downwardly opening second latch receiver oriented to receive the second motion-blocking latch upon arrival of the aperture shape changer means in the extended position to block further movement of the slidable top cover relative to the foundation and a second latch slide channel communicating with the downwardly opening second latch receiver and extending from the second latch receiver in a direction away from the oblong anchor post-receiving aperture formed in the foundation to receive the second motion-blocking latch therein during movement of the aperture shape changer means from the extended position to the retracted position after downward movement of the second motion-blocking latch toward the foundation to exit the second latch receiver and enter the second latch slide channel.

7. The carry handle anchor system of claim 6, wherein the foundation of the first anchor includes a tongue plate formed to include the oblong anchor post-receiving aperture and arranged to support the aperture shape change means for back-and-forth sliding movement relative to the oblong anchor post-receiving aperture between the retracted and extended positions to change the effective shape of the oblong anchor post-receiving aperture and a strip holder appended to a rearward end of the tongue plate to lie in a hollow cavity formed in the top-cover slide guide and coupled to an anchor mount provided at a distal end of the carry strip to tether the carry strip to the first anchor.

8. The carry handle anchor system of claim 1, wherein the foundation of the first anchor includes a strip holder coupled to a first end of the carry strip and a tongue plate formed to include the oblong anchor post-receiving aperture and coupled to the strip holder to support back-and-forth sliding movement of the aperture shape changer means to vary the effective size and shape of the oblong anchor post-receiving aperture formed in the tongue plate.

9. The carry handle anchor system of claim 8, wherein the tongue plate includes a rearward end coupled to the strip holder and a forward end arranged to lie in spaced-apart relation to the rearward end to locate the oblong anchor post-receiving aperture therebetween and wherein the first anchor further includes a cover motion blocker coupled to the forward end of the tongue plate and formed to include a rearwardly facing concave wall arranged to extend around a forward end of the oblong anchor post-receiving aperture and a spring arranged to act against the foundation and the aperture shape changer means normally to yieldably urge the aperture shape changer means along the tongue plate in a forward direction to engage the cover motion blocker to establish the extended position and to cause a forwardly facing concave end edge of the aperture shape changer means to cooperate with the rearwardly facing concave wall of the cover motion blocker to form a round passageway therebetween sized to establish the relatively smaller effective shape of the oblong anchor post-receiving aperture and to receive the medial segment of the head-support shaft therein.

10. The carry handle anchor system of claim 8, wherein the carry strip is flexible and the carry handle further includes a semi-rigid support arranged to lie in side-by-side mating engagement with an underside of the carry strip, the foundation further includes a rearwardly extending tab that is coupled to the strip holder to locate the strip holder between the rearwardly extending tab and the tongue plate, and the semi-rigid support is coupled to the rearwardly extending tab to support and rigidify the carry strip positioned to lie on a topside of the semi-rigid support along a path extending away from the rearwardly extending plate.

11. The carry handle anchor system of claim 1, wherein the foundation of the first anchor includes a tongue plate formed to include the oblong anchor post-receiving aperture and arranged to support the aperture shape changer means for back-and-forth sliding movement relative to the oblong anchor post-receiving aperture between the retracted and extended positions to change the effective size and shape of the oblong anchor post-receiving aperture.

12. The carry handle anchor system of claim 11, wherein the foundation further includes a strip holder appended to a rearward end of the tongue plate and coupled to an anchor mount provided at a distal end of the carry strip to tether the carry strip to the first anchor.

13. The carry handle anchor system of claim 12, wherein the tongue plate is also formed to include a spring-receiver aperture that opens into the oblong anchor post-receiving aperture and wherein the first anchor further includes a compression spring that includes a rearward end that is located in the spring-receiver aperture and an opposite forward end that is arranged to lie in the oblong anchor post-receiving aperture when the anchor shape changer means occupies the extended position and to lie in the spring-receiver aperture when the anchor shape changer means occupies the retracted position.

14. The carry handle anchor system of claim 1, wherein the foundation includes an inner perimeter edge that defines the boundary of the oblong anchor post-receiving aperture and includes, in series, an inner concave surface, a first side surface, an outer concave surface, and a second side surface, the slidable top cover includes a forward end that is formed to include a concave end edge that is aligned to lie in registry with the inner concave surface of the inner perimeter edge of the foundation when the aperture shape changer means occupies the retracted position and that is arranged to lie in spaced-apart opposing relation to the outer concave surface of the inner perimeter edge cooperatively to decrease the effective shape and size of the oblong anchor post-receiving aperture to establish a temporary round shape of the oblong anchor post-receiving aperture sufficient in size to receive a portion of the medial segment of the head-support shaft of the first anchor therein and to block movement of the oblong head of the first anchor post in the opposite second direction through the oblong anchor post-receiving aperture formed in the foundation of the first anchor when the aperture shape changer means occupies the extended position.

15. A carry handle anchor system comprising a first anchor post adapted to be coupled to an object to be carried, the first anchor post including a head-support shaft having a proximal end, an opposite distal end, and a medial segment therebetween and an oblong head coupled to the opposite distal end of the head-support shaft, and a carry handle including a carry strip and a first anchor coupled to a first end of the carry strip, the first anchor including a foundation formed to include an oblong anchor post-receiving aperture that has an oblong shape and is sized to allow passage of the oblong head of the first anchor post therethrough during mating of the first anchor to the first anchor post and separation of the first anchor from the first anchor post and aperture shape changer means mounted on the foundation for sliding movement between a retracted position exposing the oblong anchor post-receiving aperture to allow relative movement of the oblong head of the first anchor post in a first direction through the oblong anchor post-receiving aperture to position the medial segment of the head-support shaft in the oblong anchor post-receiving aperture during mating of the first anchor to the first anchor post and separation of the first anchor from the first anchor post and an extended position decreasing the size of the oblong anchor post-receiving aperture temporarily to a relatively smaller effective shape and size to block relative movement of the oblong head of the first anchor post in an opposite second direction through the oblong anchor-post receiving aperture formed in the foundation of the first anchor while the medial segment of the head-support shaft remains in the oblong anchor post-receiving aperture to retain the first anchor in mating engagement to the first anchor post and block separation of the first anchor from the first anchor post, wherein the foundation includes an inner perimeter edge that defines the boundary of the oblong anchor post-receiving aperture and includes, in series, an inner concave surface, a first side surface, an outer concave surface, and a second side surface, the aperture shape changer means includes a slidable top cover that includes a forward end that is formed to include a concave end edge that is aligned to lie at least in registry with the inner concave surface of the inner perimeter edge of the foundation when the aperture shape changer means occupies the retracted position and that is arranged to lie in spaced-apart opposing relation to the outer concave surface of the inner perimeter edge cooperatively to decrease the effective shape and size of the oblong anchor post-receiving aperture to establish a temporary round shape of the oblong anchor post-receiving aperture sufficient in size to receive a portion of the medial segment of the head-support shaft of the first anchor therein and to block movement of the oblong head of the first anchor post in the opposite second direction through the oblong anchor post-receiving aperture formed in the foundation of the first anchor when the aperture shape changer means occupies the extended position, and wherein the slidable top cover includes a slide plate formed to include the concave end edge at the forward end thereof and a finger grip at an opposite rearward end thereof and the finger grip is configured to provide means for engaging a finger of a user moving along the slide plate in a rearward direction from the forward end of the slide plate toward the rearward end to move the aperture shape changer means from the extended position to the retracted position to expose the oblong anchor post-receiving aperture formed in the foundation so that the oblong head of the first anchor post of the object to be carried can be passed by the user in the first direction through the oblong anchor post-receiving aperture to locate the medial segment of the head-support shaft of the first anchor post in the oblong anchor post-receiving aperture during mating of the first anchor of the carry handle to the first anchor post of the object to be carried.

16. The carry handle anchor system of claim 15, wherein the aperture shape changer means further includes a slidable bottom cover arranged to lie in spaced-apart relation to the slidable top cover to locate a portion of the foundation therebetween and coupled to the slidable top cover to move therewith relative to the foundation during movement of the aperture shape changer means between the retracted and extended positions and wherein the first anchor further includes springs means for yieldably urge the slidable bottom cover in a forward direction to cause simultaneous movement of the slidable top cover and slidable bottom cover in the forward direction so as to cause the aperture shape changer means normally to assume the extended position to decrease the effective shape and size of the oblong anchor post-receiving aperture.

17. The carry handle anchor system of claim 14, wherein the first anchor further includes a spring arranged to act between the foundation and the aperture shape changer means normally to move the aperture shape changer means in the forward direction toward the outer concave surface of the perimeter edge that defines the boundary of the oblong anchor post-receiving aperture formed in the foundation to locate the aperture shape changer means normally in the extended position.

18. The carry handle anchor system of claim 1, wherein the first anchor further includes a top-cover slide guide including a leg arranged to overlie the foundation and the motion-blocking latch during movement of the aperture shape changer means between the retracted and extended positions, and the leg is formed to include a downwardly opening latch receiver oriented to open toward the foundation to receive the motion-blocking latch therein upon arrival of the aperture shape changer means in the extended position to block further movement of the slidable top cover relative to the foundation.

19. The carry handle anchor system of claim 18, wherein the leg is also formed to include a downwardly opening latch slide channel oriented to open toward the foundation and to communicate with the latch receiver and arranged to extend away from the latch receiver in a rearward direction away from the oblong anchor post-receiving aperture formed in the foundation to receive the motion-blocking latch therein during movement of the aperture shape changer means from the extended position to the retracted position after downward movement of the motion-blocking latch toward the foundation to exit the latch receiver and enter the latch slide channel.

20. The carry handle anchor system of claim 19, wherein the leg is also formed to include stop means located in rearwardly spaced-apart relation to the latch receiver to engage and block rearward movement of the motion-blocking latch away from the oblong anchor post-receiving aperture formed in the foundation during movement of the aperture shape changer means from the extended position toward the retracted position to establish the retracted position of the aperture shape changer means.

21. The carry handle anchor system of claim 20, wherein the first anchor further includes a cover motion blocker coupled to a forward end of the foundation to lie in spaced-apart relation to the leg of the top-cover slide guide to engage a forward-facing end of the slidable top cover during movement of the aperture shape changer means from the retracted position toward the extended position to establish the extended position of the aperture shape changer means.

22. A carry handle anchor system comprising a first anchor post adapted to be coupled to an object to be carried, the first anchor post including a head-support shaft having a proximal end, an opposite distal end, and a medial segment therebetween and an oblong head coupled to the opposite distal end of the head-support shaft, and a carry handle including a carry strip and a first anchor coupled to a first end of the carry strip, the first anchor including a foundation formed to include an oblong anchor post-receiving aperture that has an oblong shape and is sized to allow passage of the oblong head of the first anchor post therethrough during mating of the first anchor to the first anchor post and separation of the first anchor from the first anchor post and an aperture shape changer mounted on the foundation for sliding movement between a retracted position exposing the oblong anchor post-receiving aperture to allow relative movement of the oblong head of the first anchor post in a first direction through the oblong anchor post-receiving aperture to position the medial segment of the head-support shaft in the oblong anchor post-receiving aperture during mating of the first anchor to the first anchor post and separation of the first anchor from the first anchor post and an extended position decreasing the size of the oblong anchor post-receiving aperture temporarily to a relatively smaller effective shape and size to block relative movement of the oblong head of the first anchor post in an opposite second direction through the oblong anchor-post receiving aperture formed in the foundation of the first anchor while the medial segment of the head-support shaft remains in the oblong anchor post-receiving aperture to retain the first anchor in mating engagement to the first anchor post and block separation of the first anchor from the first anchor post, wherein the first anchor includes a cover motion blocker coupled to a forward end of the foundation and an anti-rotation lug coupled to the cover motion blocker and arranged to extend downwardly below the foundation and wherein the first anchor post further includes a rotation-blocker platform coupled to the proximal end of the head-support shaft to lie in spaced-apart relation to the oblong head and the rotation-blocker platform includes a first stop and a second stop arranged to lie in spaced-apart relation to the first stop to locate the anti-rotation lug therebetween to allow rotation of the first anchor about an axis of rotation established by the head-support shaft of the first anchor from an upright use position to a first-side storage position in response to rotation of the first anchor in a counterclockwise direction through an angle of about 90° to cause a first side of the anti-rotation lug to engage the first stop of the rotation-blocker platform and from the upright use position to a second-side storage position in response to rotation of the first anchor in a clockwise direction through an angle of about 90° to cause an opposite second side of the anti-rotation lug to engage the second stop of the rotation-blocker platform.

* * * * *